US007497559B2

(12) United States Patent
Shin et al.

(10) Patent No.: US 7,497,559 B2
(45) Date of Patent: Mar. 3, 2009

(54) PIEZOELECTRIC INKJET PRINTHEAD AND METHOD OF MANUFACTURING THE SAME

(75) Inventors: Su-ho Shin, Seongnam-si (KR); Sung-gyu Kang, Suwon-si (KR); Jae-woo Chung, Suwon-si (KR); You-seop Lee, Yongin-si (KR); Chang-hoon Jung, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 413 days.

(21) Appl. No.: 11/245,131

(22) Filed: Oct. 7, 2005

(65) Prior Publication Data

US 2006/0077237 A1 Apr. 13, 2006

(30) Foreign Application Priority Data

Oct. 7, 2004 (KR) ..... 10-2004-0079959

(51) Int. Cl.
*B41J 2/045* (2006.01)

(52) U.S. Cl. ..... 347/71

(58) Field of Classification Search ..... 347/68, 347/70–72

See application file for complete search history.

(56) References Cited

U.S. PATENT DOCUMENTS 4,730,197 A 3/1988 Raman et al.
5,856,837 A 1/1999 Kitahara et al.
2003/0112300 A1 6/2003 Chung et al.
2004/0041881 A1 3/2004 Okuda et al.

FOREIGN PATENT DOCUMENTS

EP 0 985 534 3/2000
EP 1 321 294 6/2003

*Primary Examiner*—An H Do
(74) *Attorney, Agent, or Firm*—Lee & Morse, P.C.

(57) ABSTRACT

A piezoelectric inkjet printhead capable of reducing a crosstalk and a method of manufacturing the same are provided. The inkjet printhead includes an upper substrate, an intermediate substrate, and a lower substrate that are sequentially stacked, wherein the upper substrate includes piezoelectric actuators on an upper surface of the upper substrate and pressure chambers and first restrictors on a lower surface of the upper substrate, the first restrictors extending from the pressure chambers and having a width smaller than a width of the pressure chambers, the intermediate substrate includes dampers passing therethrough, the dampers corresponding to the pressure chambers and second restrictors extending between the first restrictors and a manifold formed from a lower surface of the intermediate substrate and the lower substrate includes nozzles passing therethrough, the nozzles corresponding to the dampers.

20 Claims, 22 Drawing Sheets

PIEZOELECTRIC INKJET PRINTHEAD AND METHOD OF MANUFACTURING THE SAME

BACKGROUND OF THE INVENTION

1. Field of the Invention

The present invention relates to an inkjet printhead. More particularly, the present invention relates to a piezoelectric inkjet printhead capable of reducing a crosstalk and a method of manufacturing the same.

2. Description of the Related Art

An inkjet printhead is a device for ejecting fine ink droplets for use in printing. For example, it is used to print at a desired point on a paper and to print an image of a predetermined color. Inkjet printheads can be generally divided into two types according to the type of ink ejection employed. One type is a thermally-driven inkjet printhead that creates a bubble in ink using a heat source, to thereby eject the ink using the expansion force of the bubble. The other type is a piezoelectric inkjet printhead that uses a piezoelectric element to eject ink using a pressure applied to the ink, which is generated by deformation of the piezoelectric element.

The construction of a typical piezoelectric inkjet printhead is illustrated in FIG. 1. Referring to FIG. 1, a manifold 2, a restrictor 3, a pressure chamber 4 and a nozzle 5, which together constitute an ink channel, are formed in the inside of a channel plate 1. A piezoelectric actuator 6 is disposed on the channel plate 1. The manifold 2 is a path through which ink flowing from an ink reservoir (not shown) is supplied to one or more pressure chambers 4. The restrictor 3 is a path through which the ink flows from the manifold 2 to the pressure chamber 4. The pressure chamber 4 is a space filled with ink to be ejected. A pressure change, for ejection or refill of ink, is generated in the pressure chamber 4 by changing its volume by driving the piezoelectric actuator 6. The piezoelectric actuator 6 may deform an upper wall of the pressure chamber 4, which may serve as a vibration plate 1*a*.

In operation, when the piezoelectric actuator 6 is driven to inwardly deform the vibration plate 1*a*, the volume of the pressure chamber 4 is reduced, resulting in a pressure change. Ink in the inside of the pressure chamber 4 is ejected to the outside through the nozzle 5 by the pressure change in the inside of the pressure chamber 4. Subsequently, when the piezoelectric actuator 6 is driven to outwardly deform and restore the vibration plate 1*a* to its original shape, the volume of the pressure chamber 4 increases, resulting in a second pressure change. The second pressure change causes ink to flow into the the pressure chamber 4 from the manifold 2 through the restrictor 3 due to the increased volume.

A conventional piezoelectric inkjet printhead is illustrated in FIG. 2. Referring to FIG. 2, the conventional piezoelectric inkjet printhead is formed by stacking and bonding thin plates 11 through 16. In particular, a first plate 11, having nozzles 11*a* for ejecting ink, is disposed at the lowermost side of the printhead, a second plate 12, having a manifold 12*a* and ink outlets 12*b*, is stacked thereon and a third plate 13, having ink inlets 13*a* and ink outlets 13*b*, is stacked on the second plate 12. The third plate 13 has an ink introducing port 17 for introducing ink to the manifold 12*a* from an ink reservoir (not shown). A fourth plate 14, having ink inlets 14*a* and ink outlets 14*b*, is stacked on the third plate 13 and a fifth plate 15 having pressure chambers 15*a*, the ends of which communicate with the ink inlets 14*a* and the ink outlets 14*b*, respectively, is stacked on the fourth plate 14. The ink inlets 13*a* and 14*a* serve as paths through which ink flows from the manifold 12*a* to the pressure chambers 15*a*, and the ink outlets 12*b*, 13*b*, and 14*b* serve as paths through which ink is discharged from the pressure chambers 15*a* to the nozzles 11*a*. A sixth plate 16 closing the upper portion of the pressure chambers 15*a* is stacked on the fifth plate 15, and drive electrodes 20 and piezoelectric films 21 serving as piezoelectric actuators are formed on the sixth plate 16. Thus, the sixth plate 16 serves as a vibration plate that is vibrated by the piezoelectric actuator and changes the volume of the pressure chamber 15*a* disposed beneath it using warp-deformation of the sixth plate 16.

FIG. 3 illustrates a view of another example of a piezoelectric inkjet printhead and FIG. 4 illustrates a vertical sectional view of the same. The inkjet printhead illustrated in FIGS. 3 and 4 may have a structure in which three silicon substrates 30, 40 and 50 are stacked and bonded. Pressure chambers 32 of a predetermined depth may be formed on a backside of the upper substrate 30. An ink inlet port 31, connected to an ink reservoir (not shown), may pass through one side of the upper substrate 30. The pressure chambers 32 may be arranged in two columns, one on each side of the printhead, in a lengthwise direction of a manifold 41 formed on the intermediate substrate 40. Piezoelectric actuators 60, for providing driving force to eject ink to the pressure chambers 32, may be formed on an upper surface of the upper substrate 30. The intermediate substrate 40 may have the manifold 41, which may be connected with the ink inlet port 31 and restrictors 42. The restrictors 42 may be connected with the respective pressure chambers 32 formed on both sides of the manifold 41. Also, dampers 43 vertically passing through the intermediate substrate 40 may be formed on the intermediate substrate 40 in positions that correspond to the pressure chambers 32. Also, nozzles 51 connected with the dampers 43 may be formed in a lower substrate 50.

In operation, ink that has flowed into the manifold 41 through the ink inlet port 31 flows into the pressure chambers 32 by way of the restrictors 42. Subsequently, when the piezoelectric actuators 60 operate to pressurize the pressure chambers 32, the ink within the pressure chambers 32 passes through the dampers 43 and is ejected to the outside through the nozzles 51. Here, the restrictors 42 not only serve as paths supplying the ink from the manifold 41 to the pressure chambers 32 but may also prevent the ink from flowing backward to the manifold 41 from the pressure chambers 32 when the ink is ejected.

However, when the piezoelectric actuators 60 pressurize the pressure chambers 32, the pressure transferred to the pressure chambers 32 may also be transferred to the restrictors 42. Such a situation may generate crosstalk between adjacent restrictors 42. In this regard, crosstalk means mutual interference of pressures between adjacent restrictors 42, generated when ink is ejected. Crosstalk may affect the size of an ink droplet ejected from the nozzles 51, causing ink ejection to become non-uniform. That is, when crosstalk is generated, unintended ink may be ejected or an inaccurate amount of ink may be ejected, thus deteriorating print quality.

SUMMARY OF THE INVENTION

The present invention is therefore directed to a piezoelectric inkjet printhead capable of reducing a crosstalk and a method of manufacturing the same, which substantially overcome one or more of the problems due to the limitations and disadvantages of the related art.

It is therefore a feature of an embodiment of the present invention to provide an inkjet printhead exhibiting reduced crosstalk between restrictors.

It is therefore a further feature of an embodiment of the present invention to provide an inkjet printhead formed of three substrates, wherein it is possible to increase the width of a manifold by processing the backside of an intermediate substrate so as to form the manifold and install the manifold in a lower portion of a pressure chamber formed in an upper substrate.

It is therefore also a feature of an embodiment of the present invention to provide an inkjet printhead having one or more partitions interposed between adjacent restrictors.

At least one of the above and other features and advantages of the present invention may be realized by providing a piezoelectric type inkjet printhead including an upper substrate, an intermediate substrate, and a lower substrate that are sequentially stacked, wherein the upper substrate may include piezoelectric actuators on an upper surface of the upper substrate and pressure chambers and first restrictors on a lower surface of the upper substrate, the first restrictors extending from the pressure chambers and having a width smaller than a width of the pressure chambers, the intermediate substrate may include dampers passing therethrough, the dampers corresponding to the pressure chambers and second restrictors extending between the first restrictors and a manifold formed from a lower surface of the intermediate substrate, and the lower substrate may include nozzles passing therethrough, the nozzles corresponding to the dampers.

A part of the intermediate substrate that defines an upper surface of the manifold may also define a lower surface of the pressure chambers. The second restrictors may pass through the part of the intermediate substrate. The upper substrate, the intermediate substrate and the lower substrate may each formed of a single-crystal silicon substrate The upper substrate may be formed from a silicon on isolator wafer that includes a first silicon substrate, an intermediate oxide film, and a second silicon substrate, sequentially stacked, and the pressure chambers and the first restrictors are formed out of the first silicon substrate, and the second silicon substrate serves as a vibration plate for the piezoelectric actuators.

The intermediate substrate may further include at least one support pillar that contacts the lower substrate, the support pillar extending from a surface of the intermediate substrate that defines an upper surface of the manifold. The intermediate substrate may further include a blocking wall disposed between adjacent restrictors and extending from a surface of the intermediate substrate that defines an upper surface of the manifold. A width of the first restrictors in a width direction of the pressure chambers may be less than, or greater than, a width of the second restrictors in the width direction of the pressure chambers.

The manifold may have a partition wall formed therein along the length direction of the manifold, the partition wall extending from a surface of the intermediate substrate that defines an upper surface of the manifold and the partition wall may contact the lower substrate.

At least one of the above and other features and advantages of the present invention may also be realized by providing a method of manufacturing a piezoelectric type inkjet printhead, including, in an upper substrate, forming an ink introducing port, pressure chambers, and first restrictors connected with the pressure chambers, in an intermediate substrate, forming a manifold to a predetermined depth from a lower surface of the intermediate substrate, second restrictors connected to the manifold, and dampers passing through the intermediate substrate, in a lower substrate, forming nozzles passing through the lower substrate, bonding the lower substrate, the intermediate substrate and the upper substrate to each other such that the manifold connects with the ink introducing port, the second restrictors connect with the first restrictors, the dampers connect with the pressure chambers, and the nozzles connect with the dampers, and forming piezoelectric actuators on the upper substrate.

The method may further include forming a base mask on each of the three substrates, the base mark serving as an alignment reference in the bonding of the substrates. The ink introducing port, the pressure chambers, and the first restrictors may be formed by etching a lower surface of the upper substrate. Each of the upper substrate, intermediate substrate and lower substrate may be formed from a single crystal silicon wafer, the upper substrate is an SOI wafer including a first silicon substrate, an intermediate oxide film, and a second silicon substrate sequentially stacked, and forming the ink introducing port, the pressure chambers, and the first restrictors may include etching using the intermediate oxide film as an etch stop layer. Forming a manifold to a predetermined depth from a lower surface of the intermediate substrate, second restrictors connected to the manifold, and dampers passing through the intermediate substrate may include forming a first etch mask having a predetermined pattern on a lower surface of the intermediate substrate, forming the manifold and a lower portion of the dampers by etching the lower surface of the intermediate substrate to a predetermined depth using the first etch mask, forming a second etch mask having a predetermined pattern on an upper surface of the intermediate substrate, and forming the second restrictors and an upper portion of the dampers that is connected with the lower portion of the dampers by etching the upper surface of the intermediate substrate to a predetermined depth using the second etch mask.

Forming nozzles passing through the lower substrate may include forming ink guide parts connected with the dampers by etching an upper surface of the lower substrate to a predetermined depth, and forming ink ejection ports connected with the ink guide parts by etching a lower surface of the lower substrate. The lower substrate may be formed from a single crystal silicon wafer having a major surface parallel to a (100) crystal plane, and the ink guide parts may be formed to have inclined side surfaces by using an anisotropic etch process. The bonding of the three substrates may be performed by silicon direct bonding. The method may further include forming a silicon oxide film on the upper substrate before forming the piezoelectric actuators.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
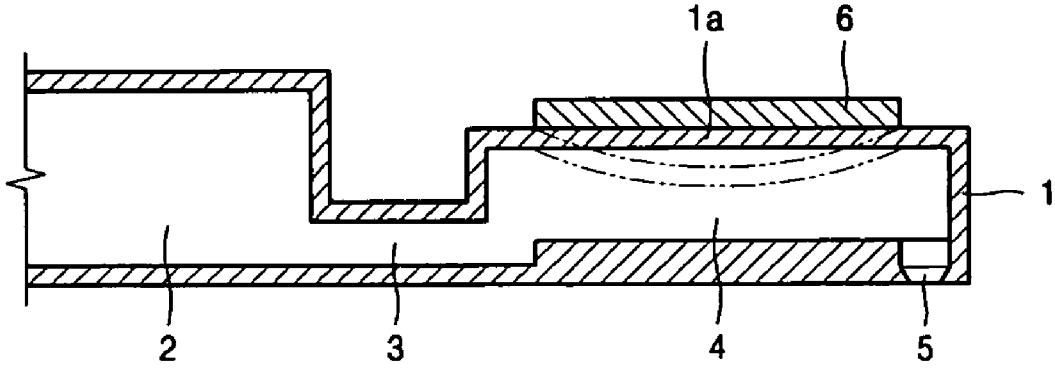
FIG. 1 (PRIOR ART)
FIG. 1 illustrates the construction of a typical piezoelectric inkjet printhead.
Figure 2:
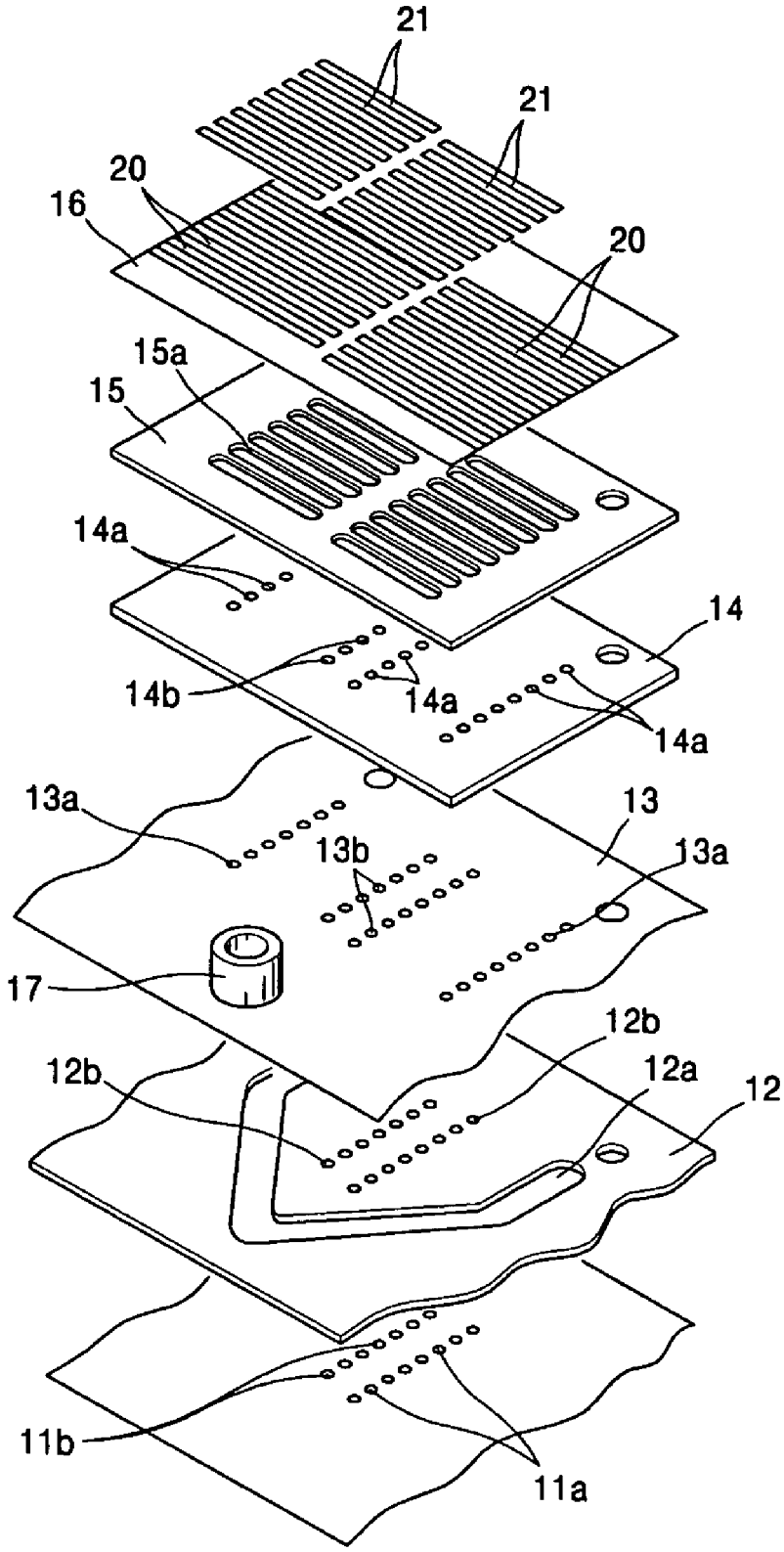
FIG. 2 (PRIOR ART)
FIG. 2 illustrates a conventional piezoelectric inkjet printhead.
Figure 3:
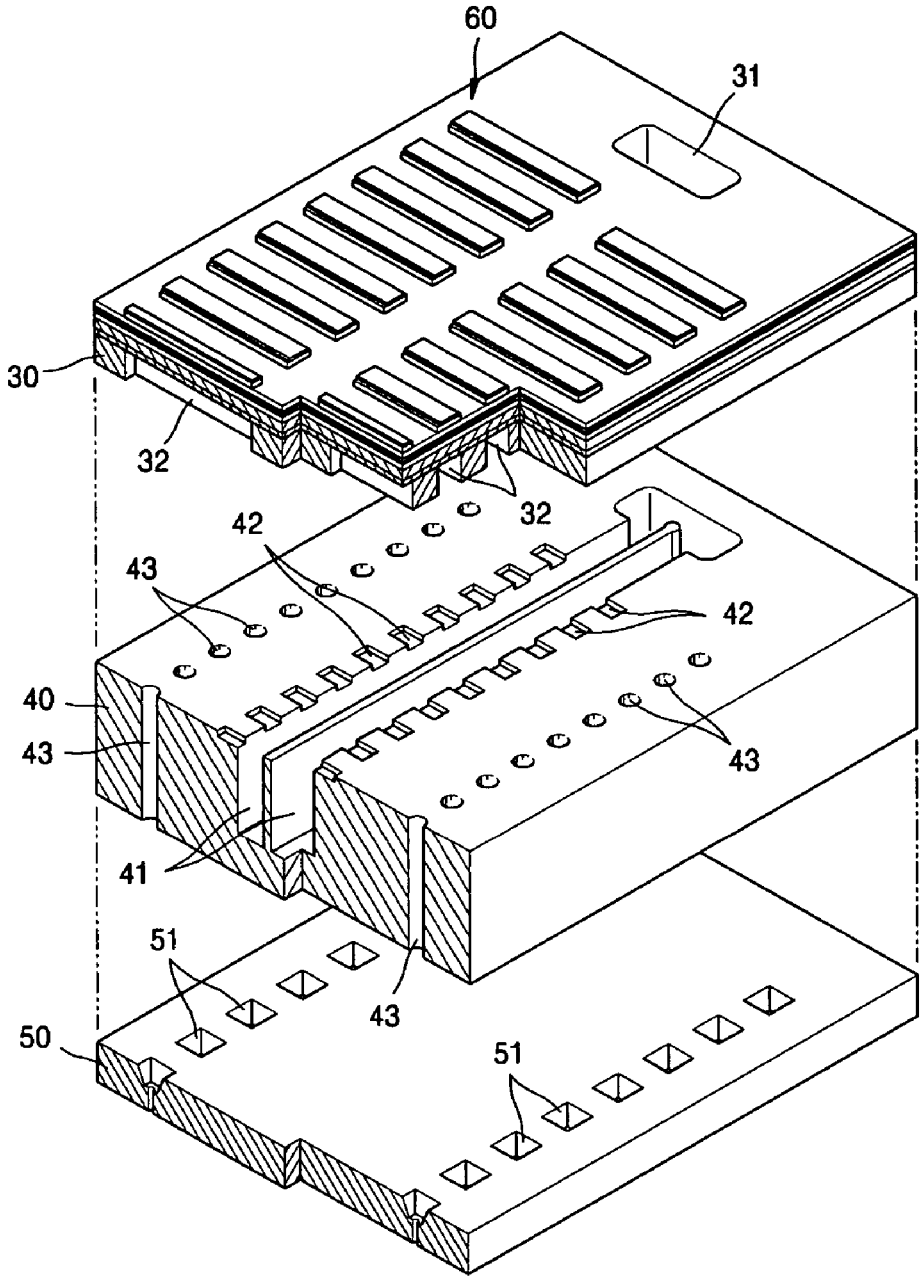
FIG. 3 (PRIOR ART)
FIG. 3 illustrates a view of another example of a piezoelectric inkjet printhead.
Figure 4:
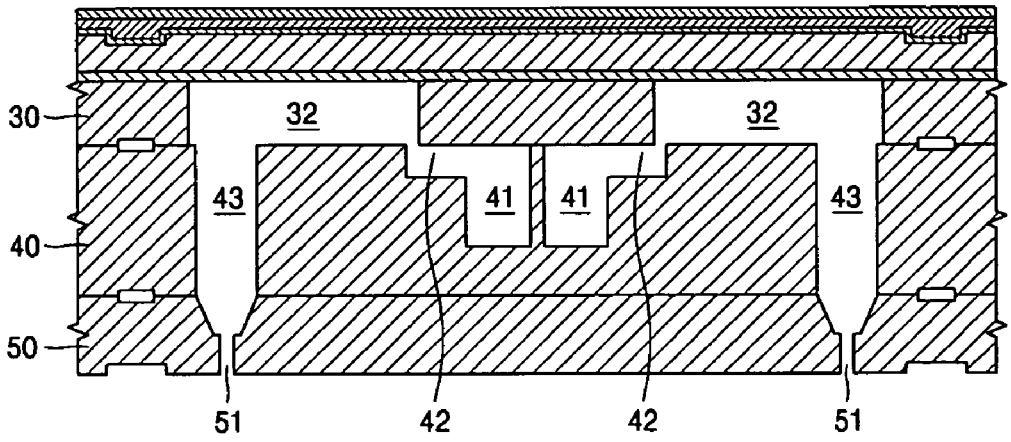
FIG. 4 (PRIOR ART)
FIG. 4 illustrates a vertical sectional view of the piezoelectric inkjet printhead illustrated in FIG. 3.

Korean Patent Application No. 10-2004-0079959, filed on Oct. 7, 2004, in the Korean Intellectual Property Office, and entitled: "Piezoelectric Type Inkjet Printhead and Method of Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 5:
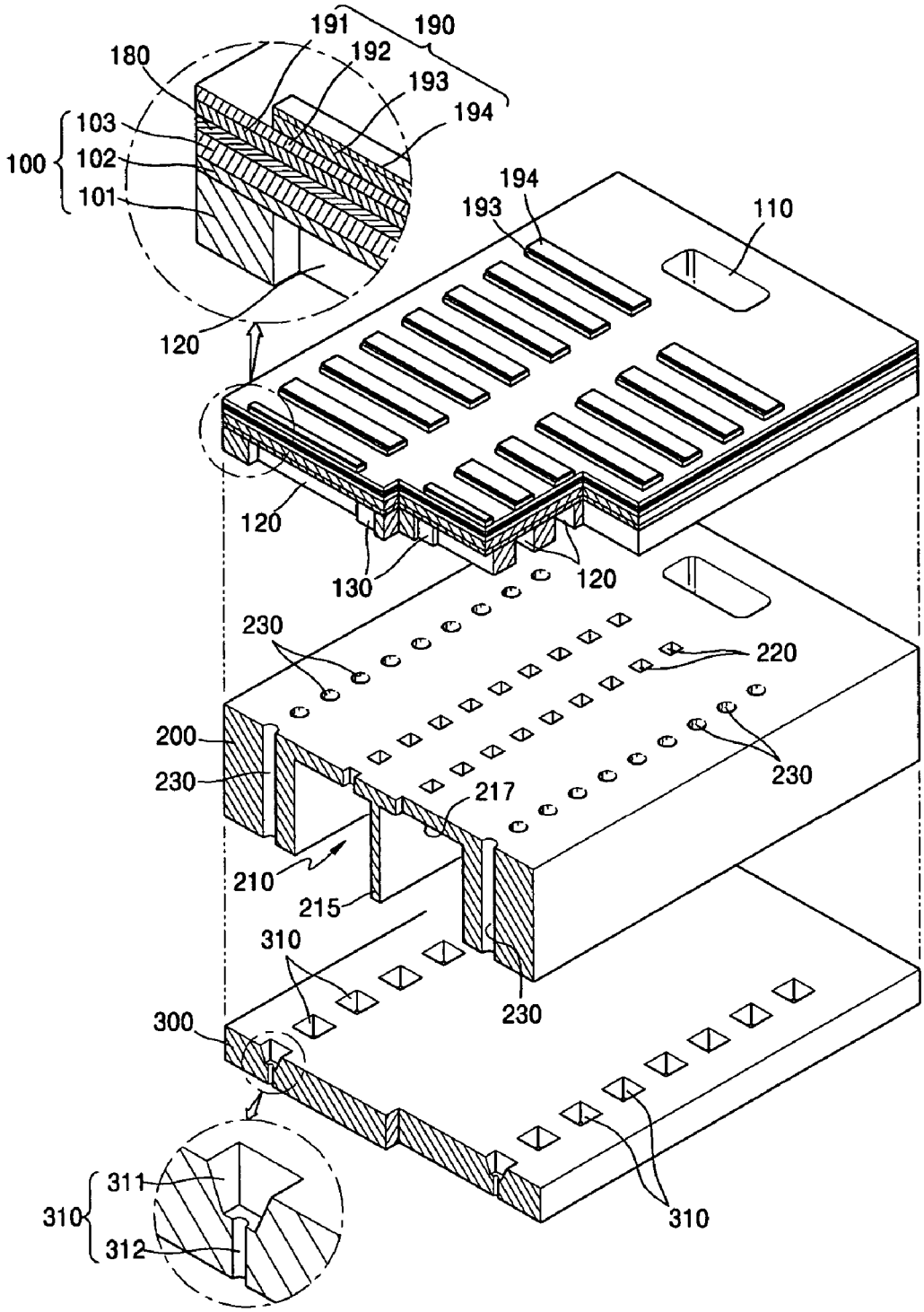
FIG. 5 illustrates an exploded perspective view of a piezoelectric inkjet printhead according to an embodiment of the present invention.
Figure 6:
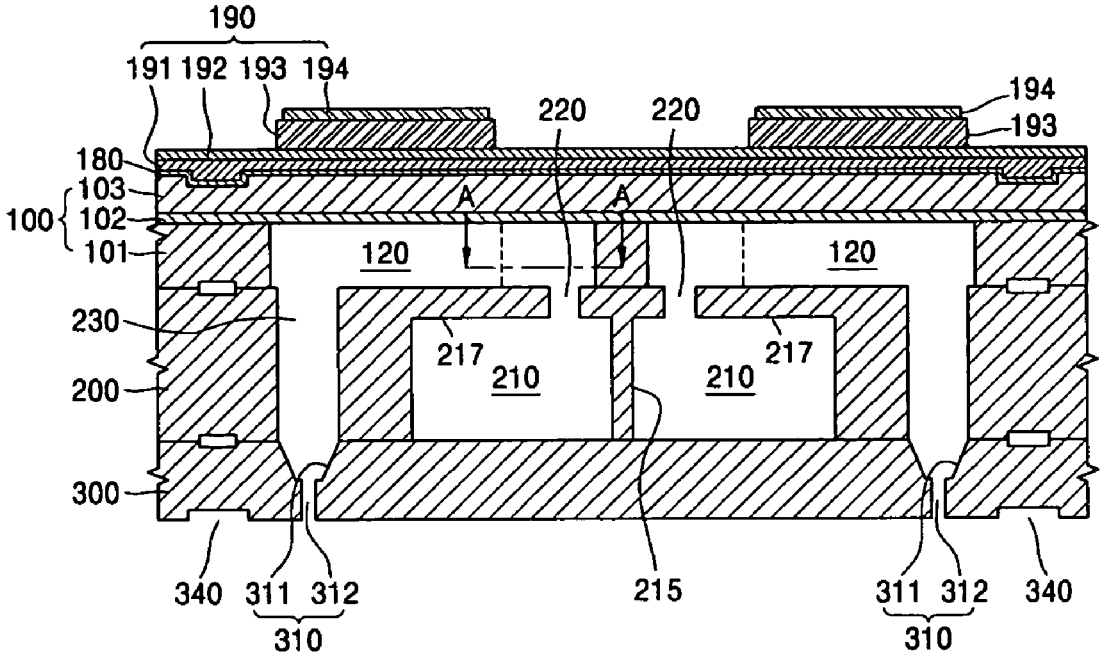
FIG. 6 illustrates a partial sectional view of the printhead illustrated in FIG. 5, taken along the lengthwise direction of the pressure chambers.
Figure 7:
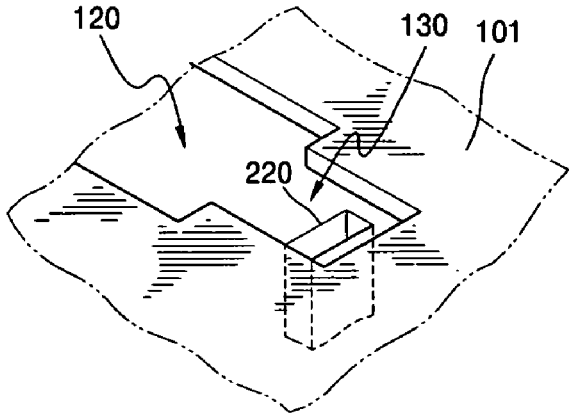
FIG. 7 illustrates a partial perspective view taken along a line A-A of FIG. 6.

FIG. 5 illustrates an exploded perspective view of a piezoelectric inkjet printhead according to an embodiment of the present invention, FIG. 6 illustrates a partial sectional view of the printhead illustrated in FIG. 5, taken along the lengthwise direction of the pressure chambers, and FIG. 7 illustrates a partial perspective view taken along a line A-A of FIG. 6.

Referring to FIGS. 5 through 7, the piezoelectric type inkjet printhead may include three substrates 100, 200 and 300 stacked and bonded together. Each of the three substrates may have elements constituting an ink channel thereon. Particularly, piezoelectric actuators 190, for generating a driving force for use in ejecting ink, may be formed on the upper substrate 100. Each of the three substrates 100, 200 and 300 may be formed of a single-crystal silicon wafer to allow the formation of elements constituting an ink channel more precisely and easily on each of the three substrates 100, 200 and 300, e.g., by using micromachining technologies such as photolithography, etching, etc.

The ink channel may include an ink introducing port 110, through which ink is introduced from an ink container (not shown), a manifold 210, in which ink that has flowed through the ink introducing port 110 is stored, first and second restrictors 130, 220, for supplying ink from the manifold 210 to a pressure chamber 120, the pressure chamber 120 filled with ink to be ejected and generating a pressure change to eject the ink, and a nozzle 310 for ejecting the ink. A damper 230 for concentrating energy generated from the pressure chamber 120 by the piezoelectric actuator 190 toward the nozzle 310 and for buffering a drastic pressure change may be formed between the pressure chamber 120 and the nozzle 310. The elements constituting the ink channel may be distributed on the three substrates 100, 200 and 300 as described above.

The pressure chambers 120, which may have a predetermined depth, and the first restrictors 130 may be formed in the backside of the upper substrate 100 and the ink introducing port 110 may be formed on one side of the upper substrate 100. The pressure chambers 120 may have a long, rectangular parallelepiped shape along a flow direction of ink and may be arranged in two columns, one on each side of a printhead chip along a lengthwise direction of the manifold 210. The pressure chambers 120 may also be arranged in one column on one side of the printhead chip along the lengthwise direction of the manifold 210. The first restrictor 130 provides a flow path that allows the ink from the manifold 210 to flow to the pressure chamber 120. The first restrictor 130 may have a width smaller than that of the pressure chamber 120 and extends from the pressure chamber 120 to connect with the second restrictor 220.

The upper substrate 100 may be formed of, e.g., a single-crystal silicon wafer of the type widely used in manufacturing integrated circuits (ICs), and more particularly, may be formed of a silicon on insulator (SOI) wafer. The SOI wafer has a structure in which a first silicon substrate 101, an intermediate oxide film 102, and a second silicon substrate 103 are sequentially stacked. The first silicon substrate 101 may be made of a single-crystal silicon and may have a thickness of about hundreds of μm. The intermediate oxide film 102 may be formed by oxidizing the surface of the first silicon substrate 101 and may have a thickness of about 1-2 μm. The second silicon substrate 103 may be made of a single-crystal silicon and may have a thickness of about tens of μm.

By using a SOI wafer for the upper substrate 100, the height of the pressure chamber 120 may be accurately controlled. That is, since the intermediate oxide film 102, which constitutes an intermediate layer of the SOI wafer, may serve as an etch stop layer, when the thickness of the first silicon substrate 101 is determined, the height of the pressure chamber 120 is determined accordingly. Also, a thickness of the vibration plate may be determined by the thickness of the second silicon substrate 103. In particular, the second silicon substrate 103, where it forms the upper wall of the pressure chamber 120, may be warp-deformed by the piezoelectric actuator 190 during operation, thus serving as a vibration plate that changes the volume of the pressure chamber 120.

The piezoelectric actuators 190 may be disposed on the upper substrate 100. A silicon oxide layer 180 may be formed as an insulation layer between the upper substrate 100 and the piezoelectric actuators 190. The piezoelectric actuator 190 may have lower electrodes 191 and 192 serving as a common electrode, a piezoelectric thin film 193 that deforms when a voltage is applied, and an upper electrode 194 serving as a drive electrode. The lower electrodes 191 and 192 may be formed on the entire surface of the silicon oxide layer 180 and may be formed of two metal thin film layers including, e.g., a Ti-layer 191 and a Pt-layer 192. The Ti-layer 191 and the Pt-layer 192 may serve not only as a common electrode but may also serve as a diffusion barrier layer to prevent interdiffusion between the piezoelectric thin film 193, on the Ti-layer 191 and the Pt-layer 192, and the upper substrate 100, beneath the Ti-layer 191 and the Pt-layer 192. The upper electrode 194 may be formed on the piezoelectric thin film 193 and serve as a drive electrode for applying a voltage to the piezoelectric thin film 193.

The piezoelectric thin film 193 may be formed on the lower electrodes 191 and 192 and may be disposed on the upper portion of the pressure chamber 120. In operation, the piezoelectric thin film 193 is deformed by application of a voltage. Such deformation of the piezoelectric thin film 193 warp-deforms a portion of the second silicon substrate 103, i.e., it warp-deforms the vibration plate of the upper substrate 100 that constitutes the upper wall of the pressure chamber 120.

The intermediate substrate 200 may include the manifold 210, which is a common channel connected with the ink introducing port 110 to supply ink, which flows through the ink introducing port 110, to the pressure chambers 120. The manifold 210 may be formed to a predetermined depth from the backside of the intermediate substrate 200, so that a ceiling wall 217 of a predetermined thickness remains on the upper portion of the manifold 210. That is, the lower end of the manifold 210 may be limited by the lower substrate 300 and the upper end of the manifold 210 may be limited by the ceiling wall 217, which is the remaining portion of the intermediate substrate 200.

As described above, when the pressure chambers 120 are arranged in two columns on both sides of a printhead chip along a lengthwise direction of the manifold 210, a partition wall 215 may formed in a lengthwise direction inside of the manifold 210. Thus, the manifold 210 may be divided into two regions, e.g., right and left regions, which is desirable for a smooth flow of the a and for preventing a crosstalk between the divided left and right regions of the manifold 210 when piezoelectric actuators 190 on both sides of the manifold 210 are driven.

The intermediate substrate 200 may have the second restrictor 220, which may be a separate channel connecting the manifold 210 with the first restrictor 130. The second restrictor 220 may be spaced apart from the partition wall 215, pass through the intermediate substrate 200, e.g., in a vertical direction, and have an exit communicating with the first restrictor 130. The second restrictor 220 may not only supply an appropriate amount of ink from the manifold 210 to the pressure chamber 120 in cooperation with the first restrictor 130, but may also prevent ink from flowing backward to the manifold 210 from the pressure chamber 120 when the ink is ejected.

A damper 230 may pass through the intermediate substrate 200 and may be formed, e.g., in a vertical direction, in a position that corresponds to one end of the pressure chamber 120, so as to connect the pressure chamber 120 with the nozzle 310.

The first restrictor 130 may extend from the pressure chamber 120 and may be formed in the upper substrate 100 and the second restrictor 220 may be formed in the intermediate substrate 200 such that it corresponds to the first restrictor 130. With the above-described structure, the first and second restrictors 130 and 220 may be formed in a central portion of the intermediate substrate 200. This may allow a greater amount of space for formation of the manifold 210. In other words, one portion of the manifold 210 may have its sides defined by the partition wall 215 and by a wall having a predetermined interval relative to the damper 230. The thickness of the wall formed by the interval relative to the damper 230 may be reduced in comparison to conventional inkjet printheads. Therefore, the width of the manifold 210 may be increased in comparison to conventional inkjet printheads.

When the width of the manifold 210 increases as described above, the volume thereof increases and thus crosstalk between the adjacent restrictors 130 and 220 may be reduced. In detail, if a pressure is applied to ink accommodated inside the pressure chamber 120 by the piezoelectric actuator 190, i.e., when the ink is ejected, the pressure is also transferred to ink inside the restrictors 130 and 220 connected with the pressure chamber 120. Further, the pressure is transferred to the manifold 210 connected with the restrictors 130 and 220, so that crosstalk between the adjacent restrictors 130 and 220 may occur. In inkjet printheads according to the present invention, the volume of the manifold 210 may be increased so that the amount of the ink that can be accommodated inside the manifold 210 may be increased. Accordingly, the intensity of the pressure transferred through the restrictors 130 and 220 per unit volume of ink inside the manifold 210 may be reduced, such that the pressure is dispersively absorbed. Since the pressure may be dispersively absorbed, the intensity of the pressure influencing the restrictors 130 and 220 may be reduced, so that crosstalk between the adjacent restrictors 130 and 220 may also be reduced.

Also, as described above, when the width of the manifold 210 is increased, the cross-sectional area increases, so that the ink ejection may operate stably at a high frequency. In detail, when the piezoelectric thin film 193 is restored after an ink droplet is ejected from the nozzle 310, the pressure within the pressure chamber 120 is reduced and ink stored in an ink container (not shown) flows into the pressure chamber 120 through the manifold 210 and the restrictor 130 and 220, to thereby replace the ink that was ejected.

By increasing the cross-sectional area of the manifold 210, a flow resistance of ink in the manifold 210 due to wall shear stress may be reduced so that ink inflow supplied through the manifold 210 is increased. Accordingly, the supply of ink under high-frequency ejection may be quickly realized. Thus, even though a large number of ink ejections may be performed in rapid sequence, the ink ejection can be stably performed by increasing the width of the manifold 210.

A nozzle 310 may be formed that pierces the lower substrate 300 in a position that corresponds to the damper 230. In detail, the nozzle 310 may be formed at the lower portion of the lower substrate 300 and may include an ink-ejection port 312, for ejecting ink, and an ink guide part 311 that is formed at the upper portion of the lower substrate 300. The ink guide part may serve to connect the damper 230 with the ink-ejection port 312 as well as pressurizing and guiding ink from the damper 230 to the ink-ejection port 312. The ink-ejection port 312 may have a shape of, e.g., a vertical hole having a predetermined diameter, and the ink guide part 311 may have, e.g., a quadrangular pyramid shape, circular pyramid shape, etc., the cross-section of which tapers toward the ink-ejection port 312. As described below, according to the present invention, a quadrangular pyramid-shaped ink guide part 311 may be easily formed in a single-crystal silicon wafer-based lower substrate 300.

As set forth above, the three substrates 100, 200 and 300, formed as described above, may be stacked and bonded to each other to yield a piezoelectric inkjet printhead according to the present invention. Thus, an ink channel including the ink introducing port 110, the manifold 210, the restrictors 130 and 220, the pressure chamber 120, the damper 230 and the nozzle 310, sequentially connected, may be formed from the three substrates 100, 200 and 300.

In the operation of an inkjet printhead formed according to the present invention, ink may flow into the manifold 210 through the ink introducing port 110 from the ink container (not shown) and may be supplied to the inside of the pressure chamber 120 through the ink restrictors 130 and 220. When a voltage is applied to the piezoelectric thin film 193 through the upper electrode 194 of the piezoelectric actuator 190 with the inside of the pressure chamber filled with the ink, the piezoelectric thin film 193 is deformed such that the second silicon substrate 103, serving as a vibration plate, is warped downward. The volume of the pressure chamber 120 is reduced by the warp-deformation of the second silicon substrate 103, which increases the pressure in the inside of the pressure chamber 120, so that the ink in the inside of the pressure chamber 120 is ejected to the outside through the nozzle 310 by way of the damper 230.

Subsequently, when the voltage applied to the piezoelectric thin film 193 of the piezoelectric actuator 190 is cut off, the piezoelectric thin film 193 is restored to its original state such that the second silicon substrate 103 serving as the vibration plate is restored to the original state and the volume of the pressure chamber 120 increases. The pressure within the pressure chamber 120 reduces and ink stored in the ink container (not shown) flows into of the pressure chamber 120 through the manifold 210 and the restrictor 130 and 220 to refill the ink in the pressure chamber 120 and thereby replace the ink that was ejected.

Figure 8:
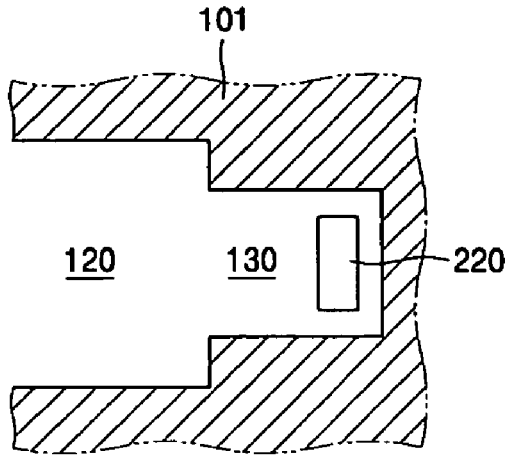
FIG. 8 illustrates a plan view of the pressure chamber and the restrictor illustrated in FIG. 7.
Figure 9:
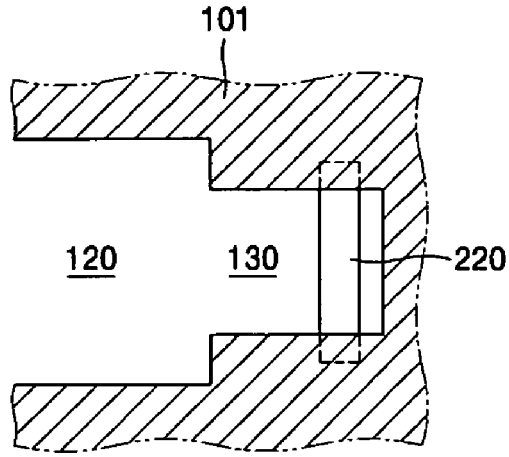
FIG. 9 illustrates a plan view of a pressure chamber and a restrictor of a printhead according to a second embodiment of the present invention.
Figure 10:
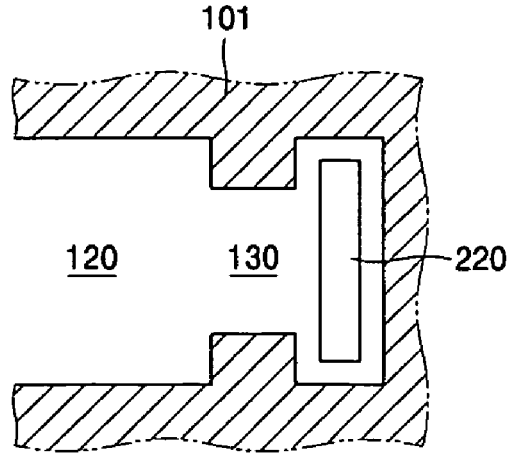
FIG. 10 illustrates a plan view of a pressure chamber and a restrictor of a printhead according to a third embodiment of the present invention.

FIG. 8 illustrates a plan view of the pressure chamber and the restrictor illustrated in FIG. 7, FIG. 9 illustrates a plan view of a pressure chamber and a restrictor of a printhead according to a second embodiment of the present invention, and FIG. 10 illustrates a plan view of a pressure chamber and a restrictor of a printhead according to a third embodiment of the present invention. As described above, for each of FIGS. 8-10, the upper substrate 100 has the pressure chamber 120 as well as the first restrictor 130 connected to the pressure chamber 120. The intermediate substrate 200 has the second restrictor 220, which corresponds to the first restrictor 130.

In the embodiment illustrated in FIG. 8, a width of the second restrictor 220 in the width direction of the pressure chamber 120 is smaller than that of the first restrictor 130 (as illustrated, the width direction of the pressure chamber 120 is defined in a vertical direction in FIG. 8). In this embodiment, even when an alignment error is generated between the upper substrate 100 and the intermediated substrate 200, the exit of the second restrictor 220 can be completely open and unobscured where it interfaces with the first restrictor 130.

In the embodiment illustrated in FIG. 9, the width of the second restrictor 220 in the width direction of the pressure chamber 120 is greater than that of the first restrictor 130. In this embodiment, even when an alignment error is generated between the upper substrate 100 and the intermediated substrate 200, the exit of the second restrictor 220 can be unaffected where it interfaces with the first restrictor 130. That is, an alignment error may have little or no effect on the area of the interface, i.e., the size of the opening, at the interface between the first and second restrictors 120, 130.

In the embodiment illustrated in FIG. 9, the width of the second restrictor 220 in the width direction of the pressure chamber 120 is smaller than that of the first restrictor 130, but is increased relative to the embodiment illustratrated in FIG. 8. Also, the width of the first restrictor 130 is increased so as to remain greater than the increased width of the second restrictor 220. The width of a portion of the first restrictor 130 where it interfaces with the second restrictor 220 may be less than, equal to, or greater than the width of the pressure chamber 120. In this embodiment, even when an alignment error is generated between the upper substrate 100 and the intermediate substrate 200, the exit of the second restrictor 220 can be completely open and unobscured where it interfaces with the first restrictor 130. In addition to the embodiments just described, a variety of embodiments in which the exit of the second restrictor 220 can be open to the necessary degree in the direction of the first restrictor 130 are envisioned, and the present invention is not limited to the orientations and relative widths described above.

Figure 11:
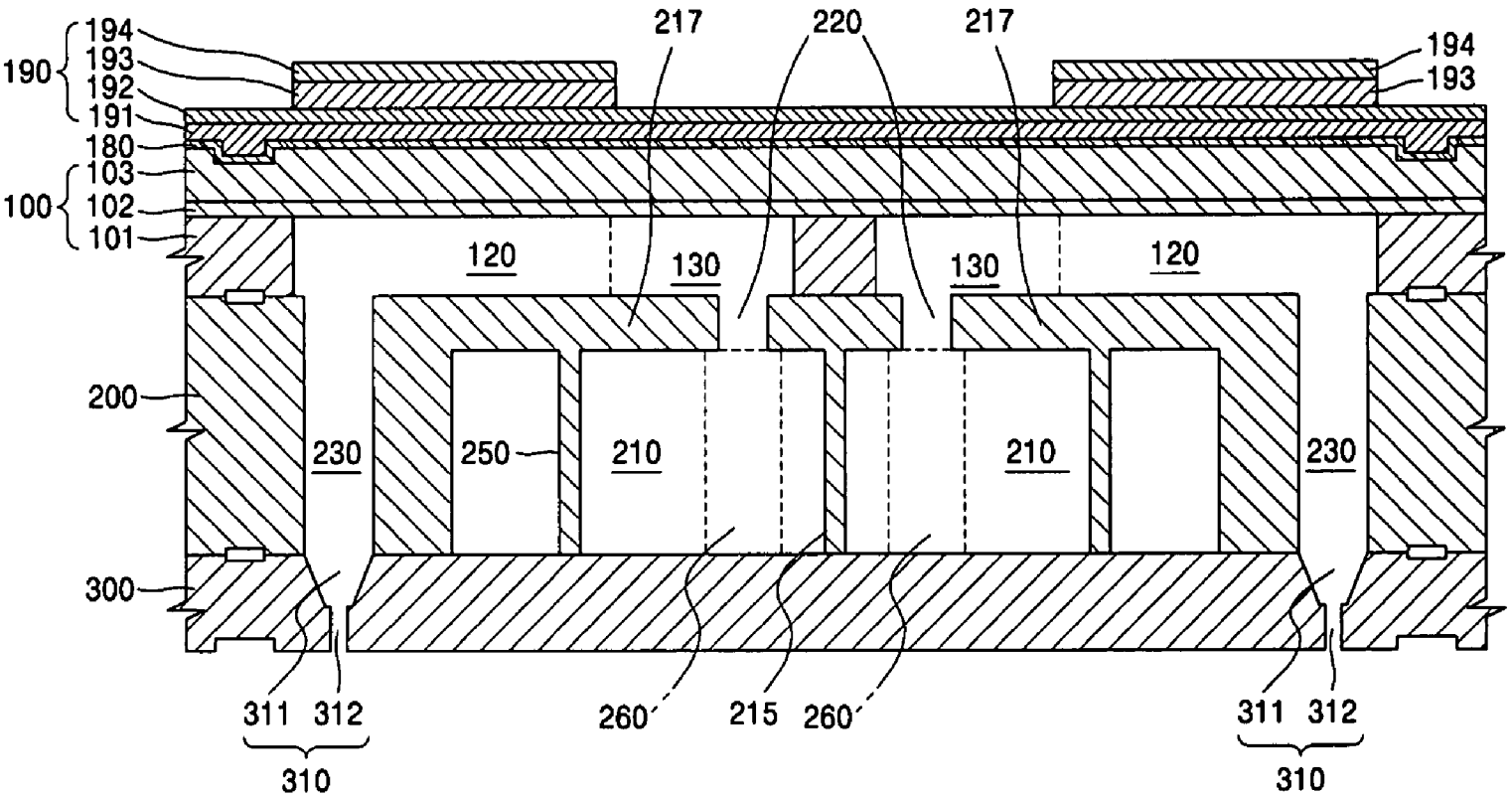
FIG. 11 illustrates a partial sectional view of an inkjet printhead, taken along the lengthwise direction of the pressure chamber, according to a fourth embodiment of the present invention.
Figure 12:
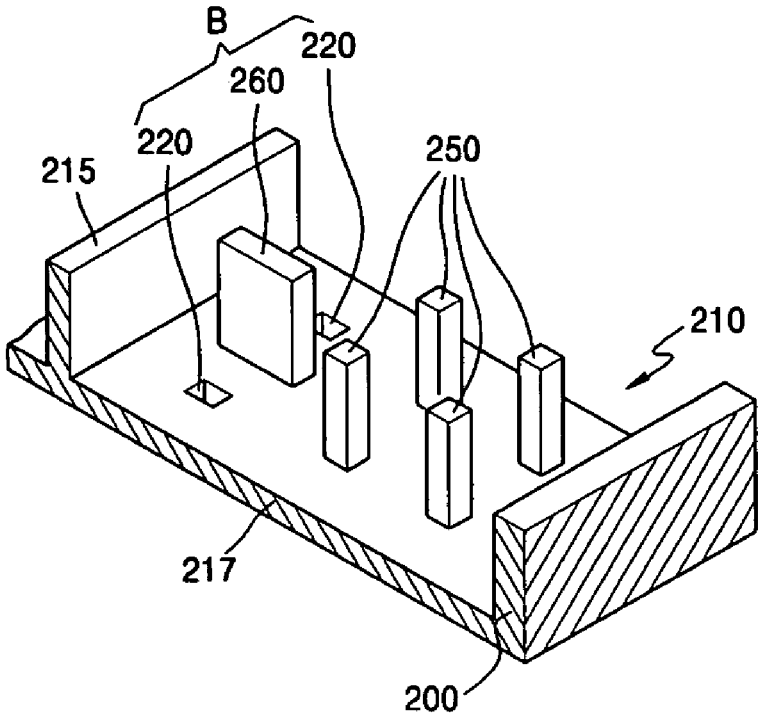
FIG. 12 illustrates a perspective view of the back side of a manifold of the intermediate substrate illustrated in FIG. 11.
Figure 13:
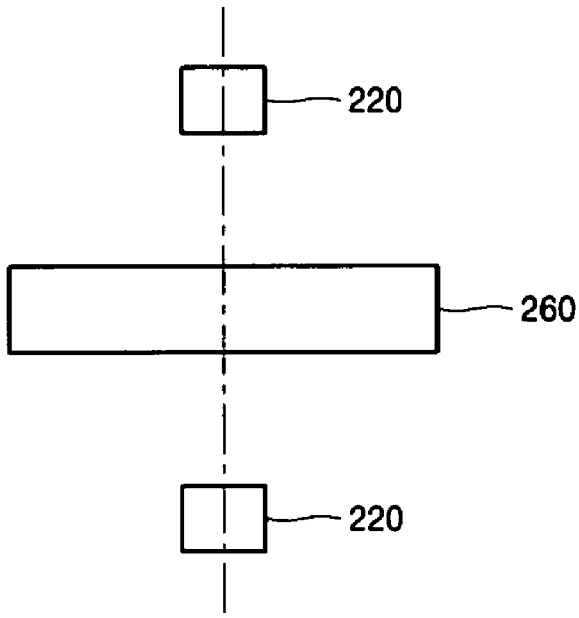
FIG. 13 illustrates a plan view of a portion B illustrated in FIG. 12.

FIG. 11 illustrates a partial sectional view of an inkjet printhead, taken along the lengthwise direction of the pressure chamber, according to a fourth embodiment of the present invention, FIG. 12 illustrates a perspective view of the back side of a manifold of the intermediate substrate illustrated in FIG. 11 and FIG. 13 illustrates a plan view of a portion B illustrated in FIG. 12. For the embodiment illustrated in FIGS. 11-13, the intermediate substrate 200 has both a support pillar 250 and a blocking wall 260 inside the manifold 210, although these elements need not be used in conjunction. Thus, they are illustrated together merely for ease of description.

The support pillar 250 may support the ceiling wall 217 of the manifold 210. That is, the support pillar 250 may extend from a surface of the intermediate substrate that defines an upper surface of the manifold. Detailing the operation of this embodiment, pressure transferred from the pressure chamber 120 may be sufficient to deform the manifold 210 inwardly. That is, the ceiling wall 217 of the manifold 210 may be deformed, resulting in a decrease in volume of the manifold 210 and possible concommitant undesired expulsion of ink. The support pillar 250 may support the ceiling wall 217 of the manifold 210 to prevent this deformation of the ceiling wall 217. The support pillar 250 may protrude from the ceiling wall 217 of the manifold 210 and may contact a lower substrate 300 to support the ceiling wall 217 of the manifold 210. A plurality of support pillars 250 may be provided as necessary to efficiently support the ceiling wall of the manifold 210. Also, the support pillar 250 may have a shape and/or arrangement such that ink flowing in the inside of the manifold 210 is not hindered.

The blocking wall 260 may serve as a blocking object to reduce crosstalk between the second restrictors 230. In detail, referring to FIG. 13, the blocking wall 260 is disposed between adjacent second restrictors 230 to reduce the influence of pressure transferred through the second restrictors 230. Therefore, the crosstalk occurring between adjacent second restrictors 230 may be reduced. The blocking wall 260 may be formed of sufficient length as compared to the length of the second restrictor 230 so as to effectively reduce crosstalk interference between the second restrictors 230.

Hereinafter, a method of manufacturing the a piezoelectric inkjet printhead according to the present invention will be described. As a general matter, the upper substrate, the intermediate substrate, and the lower substrate having the elements constituting the ink channel may be manufactured and subsequently stacked to be bonded to each other and one or more piezoelectric actuators may be formed on the upper substrate. Of course, the operations of manufacturing the upper substrate, the intermediate substrate, and the lower substrate can be performed in any order, such that the lower substrate or the intermediate substrate may be manufactured first, or two or three substrates can be simultaneously manufactured, etc. In the description that follows, the manufacturing method will be described in order of the upper substrate, the intermediate substrate, and the lower substrate, but this order is simply a matter of convenience in description.

Figure 14A:
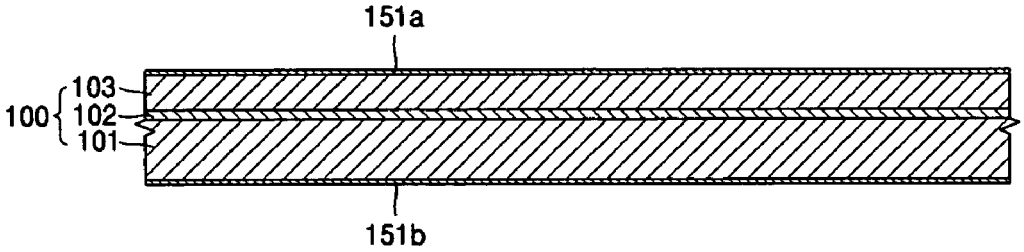
FIGS. 14A through 14E illustrate sectional views explaining operations of forming a base mark on an upper substrate in a method of manufacturing a piezoelectric type inject printhead according to the present invention.

FIGS. 14A through 14E illustrate sectional views explaining operations of forming a base mark on an upper substrate in a method of manufacturing a piezoelectric type inject printhead according to the present invention. Referring to FIG. 14A, the upper substrate 100 may be formed of a single-crystal silicon substrate. By using a single-crystal silicon substrate, widely used manufacturing techniques, e.g., those used to manufacture semiconductor devices, may be employed, thus allowing for efficient mass production. The thickness of the upper substrate 100 may be about 100-200 μm and may be determined to correspond to the height of the pressure chamber 120 that will be formed on the backside of the upper substrate 100. When an SOI wafer is used for the upper substrate 100, the height of the pressure chamber 120 may be accurately formed. As described above, the SOI wafer has a stacked structure including the first silicon substrate 101, the intermediate oxide film 102 stacked or formed on the first silicon substrate 101, and the second silicon substrate 103 bonded to or formed on the intermediate oxide film 102. As illustrated in FIG. 14A, silicon oxide films 151*a, b*, may be formed on the upper and lower, i.e., backside, surfaces of upper substrate 100 by, e.g., using an oxidization furnace to wet-oxidize or dry-oxidize the upper substrate 100.

Figure 14B:
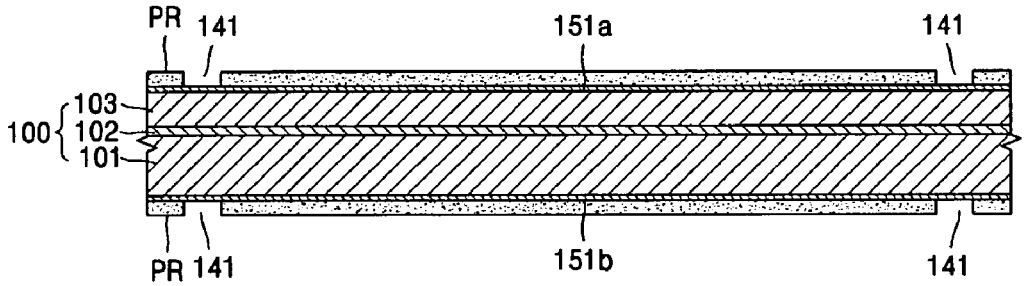
Figure 14C:
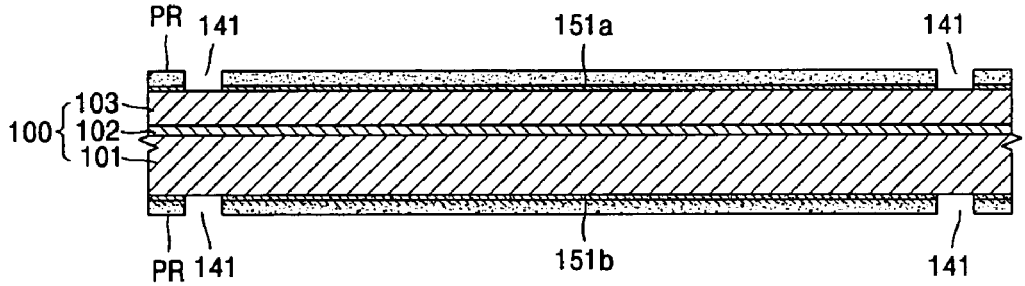

Referring to FIG. 14B, a photoresist (PR) may be spread on the surfaces of the silicon oxide films 151*a* and 151*b*. Subsequently, the spread PR may be exposed and developed so as to form an opening 141 to be used in forming a base mark in an edge portion of the upper substrate 100. Referring to FIG. 14C, the portion of the silicon oxide films 151*a* and 151*b* exposed by the opening 141 may be removed through, e.g., a wet-etching process, using the PR for an etch-mask, so that the upper substrate 100 is partially exposed. Once completed, the remaining PR may be stripped.

Figure 14D:
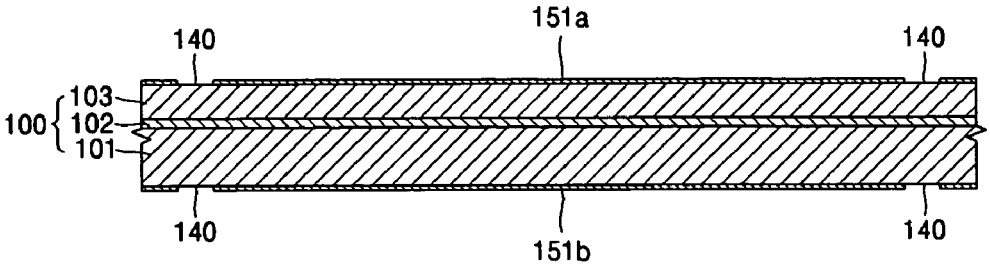

Referring to FIG. 14D, the exposed portion of upper substrate 100 may be removed by, e.g., a wet etch process, to a predetermined depth, wherein the silicon oxide films 151*a* and 151*b* serve as an etch-mask, to thereby form a base mark 140. At this point, a Tetramethyl Ammonium Hydroxide (TMAH) can be used for etchant for silicon in wet-etching the upper substrate 100. After the base mark 140 is formed, the remaining silicon oxide films 151*a* and 151*b* may be removed by, e.g., a wet etch process. In this way, any contamination formed during the above processes can be removed as well.

Figure 14E:
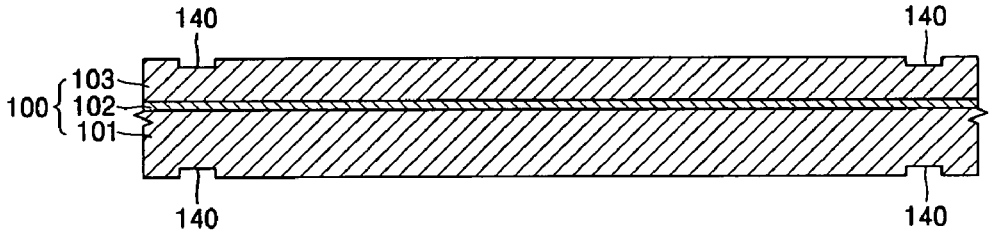

Referring to FIG. 14E, process described above may be used to form the upper substrate 100 having the base mark 140 formed on the edge portion of the upper surface and the backside of the upper substrate 100. The base mark 140 may be used in accurately aligning the upper substrate 100, the intermediate substrate 200 and a lower substrate 300, when stacking and bonding these substrates. It will be understood that the upper substrate 100 may have the base mark 140 on only the lower, or backside, thereof, or an alignment method or apparatus may be used in which the base mark 140 is not required. Accordingly, the above-described processes may be employed as the situation requires and the present invention is not limited thereby.

Figure 15A:
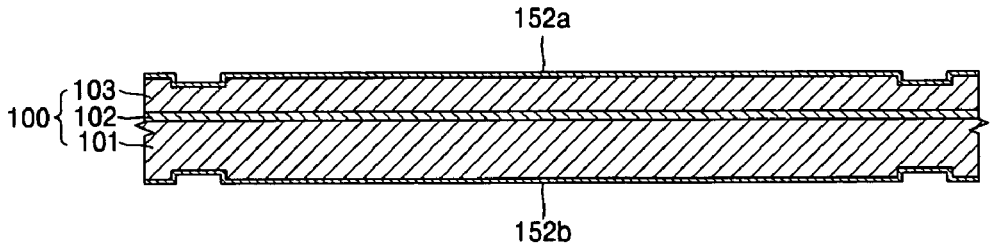
FIGS. 15A through 15G illustrate sectional views explaining operations of forming a pressure chamber and a first restrictor on an upper substrate according to the present invention.

FIGS. 15A through 15G illustrate sectional views explaining operations of forming a pressure chamber and a first restrictor on an upper substrate according to the present invention. Referring to FIG. 15A, the upper substrate 100, prepared by, e.g., the processes set forth above, may be oxidized to form silicon oxide films 152*a, b*, on the upper and lower (backside) surfaces of the upper substrate 100 by, e.g., placing the upper substrate 100 in oxidation furnace, wet-etching, dry-etching, etc. Alternatively, the silicon oxide film 152*b* alone may be formed, i.e., the upper substrate 100 may be oxidized only on its backside.

Figure 15B:
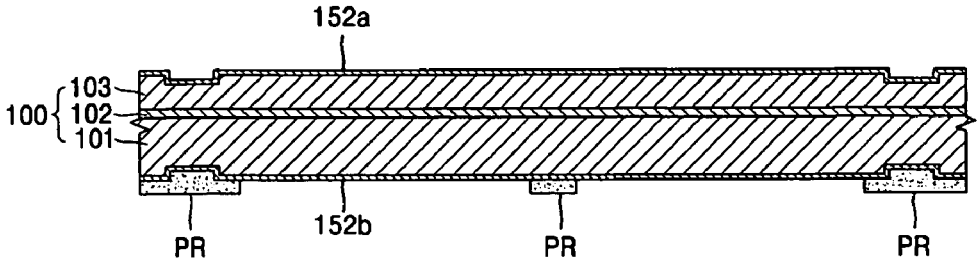
Figure 15C:
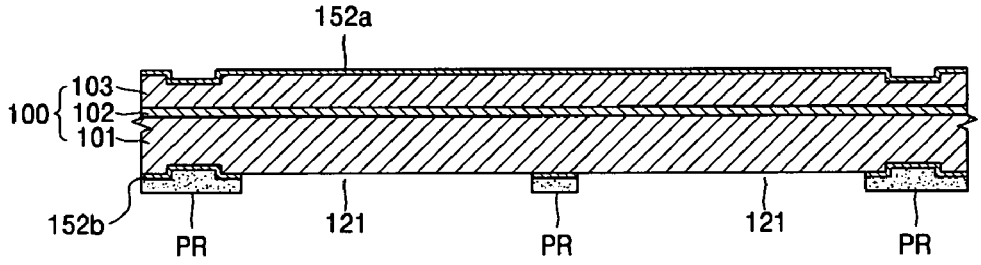

Referring to FIG. 15B, a second PR may be spread on the surface of the silicon oxide film 152*b*. The spread PR may be exposed and developed so as to form an opening 121 for forming a pressure chamber and a first restrictor on the backside of the upper substrate 100. Referring to FIG. 15C, the backside of the upper substrate 100 may be partially exposed by removing the portion of the silicon oxide film 152*b* exposed by the opening 121 through, e.g., a dry etch process such as reactive-ion-etching (RIE), while using the PR for an etch mask.

Figure 15D:
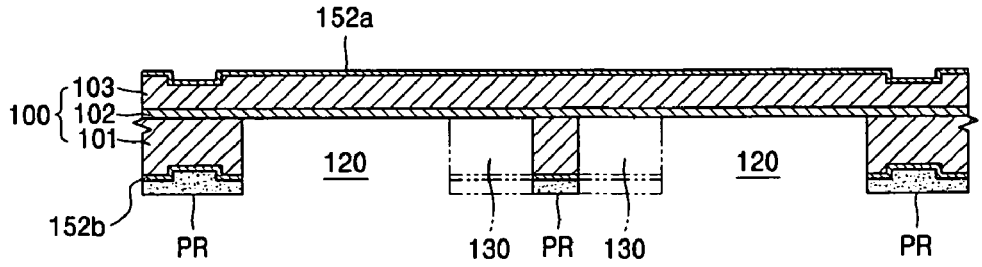

Referring to FIG. 15D, the exposed portion of the upper substrate 100 may be etched to a predetermined depth using a PR for an etch-mask to form the pressure chamber 120 and the first restrictor 130 and using the intermediate oxide film 102 as an etch stop layer. Etching of the upper substrate 100 may be performed by, e.g., dry etching using a process such as inductively coupled plasma (ICP). The depth of the features formed at this point may be determined by the thickness of the first silicon substrate 101, allowing for a precise predetermination of their depth.

In detail, when an SOI wafer is used for the upper substrate 100 as illustrated, since the intermediate oxide film 102 of the SOI wafer serves as an etch-stop layer, only the first silicon substrate 101 is etched at this stage. Accordingly, when the thickness of the first silicon substrate 101 is controlled, the pressure chamber 120 and the first restrictor 130 may be accurately controlled to a desired height. The thickness of the first silicon substrate 101 may be easily controlled during a wafer polishing process. Further, the second silicon substrate 103 constituting the upper wall of the pressure chamber 120 serves as the vibration plate as described above and the thickness thereof can be also easily controlled during the wafer polishing process.

Figure 15E:
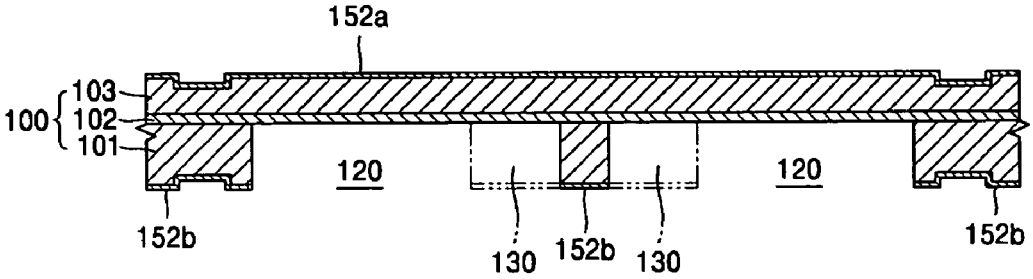

FIG. 15E represents the upper substrate 100 after the PR is stripped after the pressure chamber 120 and the first restrictor 130 are formed. Note that, at this stage, contaminants such as a by-product or polymer produced during the above-described wet-etching or dry-etching using RIE, ICP, etc., may attach on the surface of the upper surface 100. Therefore, the entire surface of the upper substrate 100 may be washed using, e.g., a tetramethyl ammonium hydroxide (TMAH) wash to remove the contaminants. The remaining silicon oxide films 152*a* and 152*b* may also be removed at this stage by, e.g., a wet etch process.

Figure 15F:
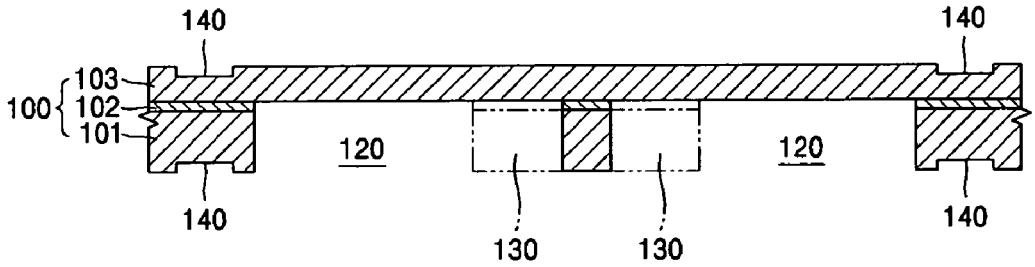

Referring to FIG. 15F, the upper substrate 100 having a base mark 140 formed in the edge portions of the upper surface and the backside, the pressure chamber 120, and the first restrictor 130 formed in the backside, have been prepared. After the pressure chamber 120 and the first restrictor 130 are formed by, e.g., dry etching the upper substrate 100 using the PR for the etch-mask, the PR is stripped. However, unlike the above process, the pressure chamber 120 and the first restrictor 130 may be formed by dry-etching the upper substrate 100 using the silicon oxide film 152*b* for the etch-mask after the PR is stripped first. That is, in the case where the silicon oxide film 152*b* formed on the backside of the upper substrate 100 is relatively thin, the etching process that forms the pressure chamber 120 and the first restrictor 130 may be performed with the PR in place. Otherwise, in the case where the silicon oxide film 152*b* is relatively thick, the etching may be performed using the silicon oxide film 152*b* for the etch-mask, after the PR has been stripped.

Figure 15G:
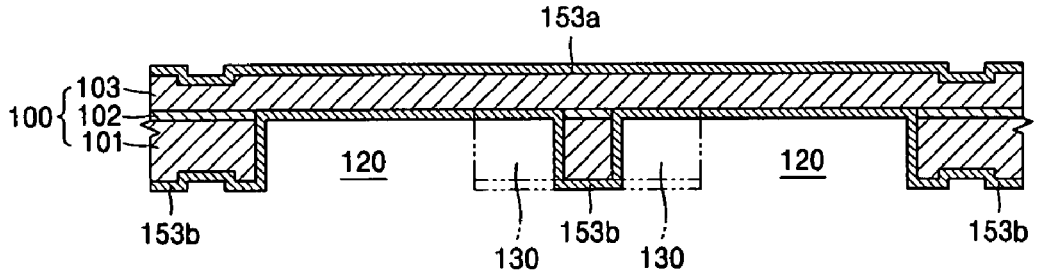

Referring to FIG. 15G, silicon oxide films 153*a* and 153*b* may be further formed on the upper surface and the backside of the upper substrate 100 illustrated in FIG. 15F (note that, if the silicon oxide films 153*a* and 153*b* are formed, an operation, described below, of forming a silicon oxide layer 180 as an insulation film on the upper substrate 100 can be omitted). When the silicon oxide film 153*b* is formed on the inside of the pressure chamber 120 and the first restrictor 130, the silicon oxide film 153*b* does not react to most kinds of ink due to the characteristic of the silicon oxide film 153*b*, so that a variety of ink can be used.

Figure 16A:
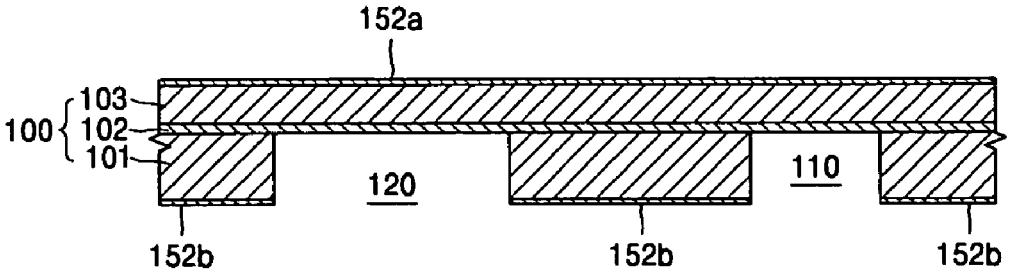
FIGS. 16A through 16D illustrate sectional views explaining operations of forming an ink introducing port on an upper substrate according to the present invention.
Figure 16B:
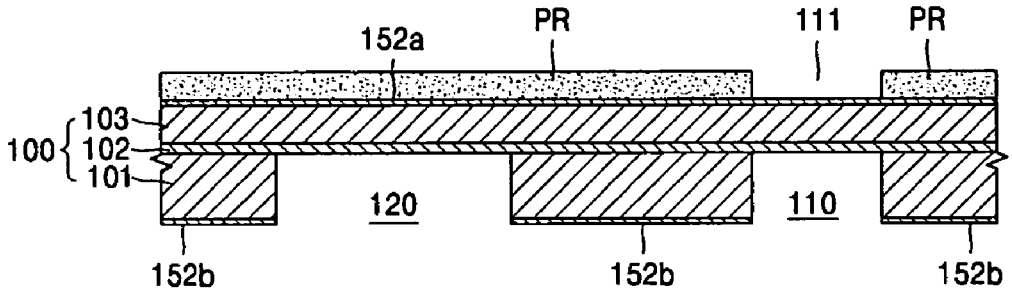

FIGS. 16A through 16D illustrate sectional views explaining operations of forming an ink introducing port on an upper substrate according to the present invention. Referring to FIG. 16A, the ink introducing port 110 may be formed together with the pressure chamber 120 by the operations illustrated in FIGS. 15A through 15G. Next, referring to FIG. 16B, a PR may be spread on the surface of the silicon oxide film 152*a*, exposed and developed, so as to form an opening 111 that may be used to piercing the ink introducing port 110 through the upper surface of the upper substrate 100.

Figure 16C:
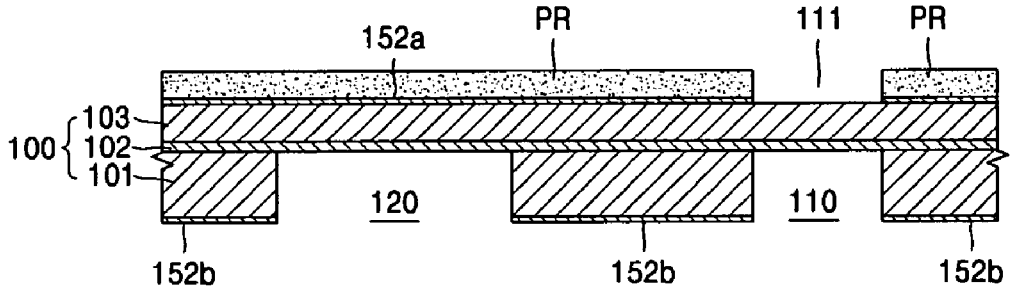
Figure 16D:
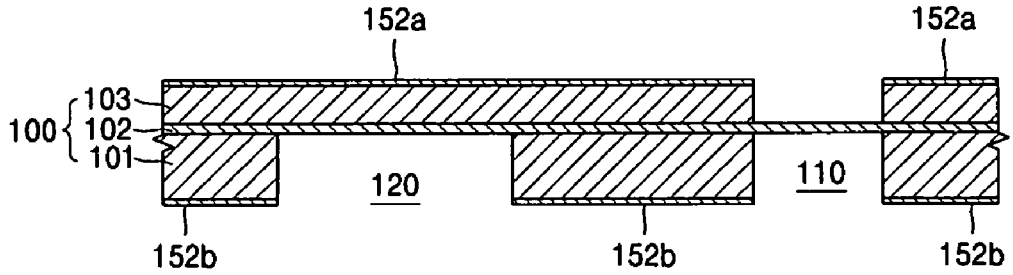

Referring to FIG. 16C, the upper surface of the upper substrate 100 may be partially exposed by removing the portion of the silicon oxide film 152*a* exposed by the opening 111 through, e.g., a dry etching process such as a reactive-ion-etching (RIE), using the PR for an etch mask. Referring to FIG. 16D, the exposed portion of the upper substrate 100 may be etched to a predetermined depth using the PR for an etch mask, after which the PR may be stripped. Etching of the upper substrate 100 may be performed by, e.g., a dry etch process such as ICP. Of course, the upper substrate 100 may be etched using the silicon oxide film 152*a* for an etch mask after having first removed the PR.

The intermediate oxide film 102 of the SOI wafer may serve as an etch-stop layer in the etching of the upper substrate 100, such that only the second silicon substrate 103 is etched and the intermediate oxide film 102 remains in the ink introducing port 110. The remaining intermediate oxide film 102 may be removed by processes such as those as described above to pierce the upper substrate and thereby complete the ink introducing port 110. The upper substrate 100 may be completed by the operations illustrated in FIGS. 15F and 15G, as described above.

It will be understood that the formation of the ink introducing port on the upper substrate 100 may be performed after forming the piezoelectric actuator. That is, part of the lower portion of the ink introducing port 110 may be formed together with the pressure chamber 120 by the operations illustrated in FIGS. 15A through 15G. In the operation illustrated in FIG. 15E, the pressure chamber 120 of a predetermined depth and part of the ink introducing port 110 of the same depth as the pressure chamber 120 may be formed on the backside of the upper substrate 100. The ink introducing port 110 formed at a predetermined depth in the backside of the upper substrate 100 may be formed so as to connect with an ink storage (not shown) through a post processing of piercing the upper substrate 100 after processes of bonding the substrates and installing the piezoelectric actuator thereon are completed. That is, the piercing of the ink introducing port 100 may be performed after the operation of forming the piezoelectric actuator is completed.

Figure 17A:
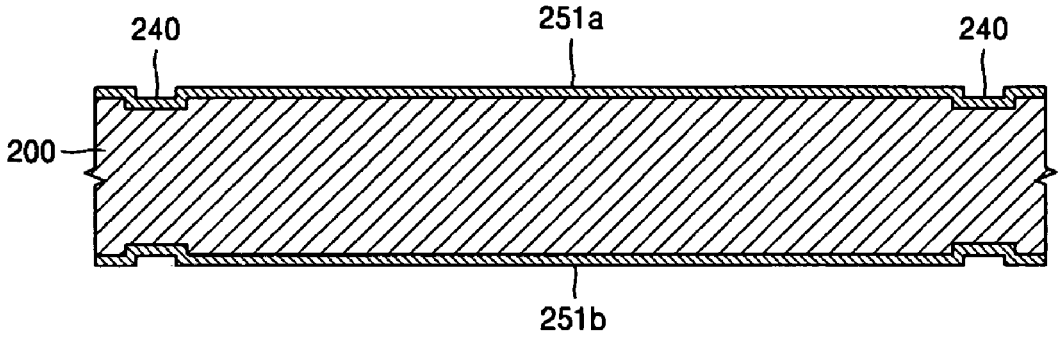
FIGS. 17A through 17H illustrate sectional views explaining operations of forming the second restrictor on an intermediate substrate according to the present invention.

FIGS. 17A through 17H illustrate sectional views explaining operations of forming the second restrictor on an intermediate substrate according to the present invention. Referring to FIG. 17A, the intermediate substrate 200 may be formed of a single-crystal silicon substrate and has a thickness of 200-300 μm. The thickness of the intermediate substrate 200 may be determined according to the dimensions of the manifold 210 and the damper 230.

Figure 17B:
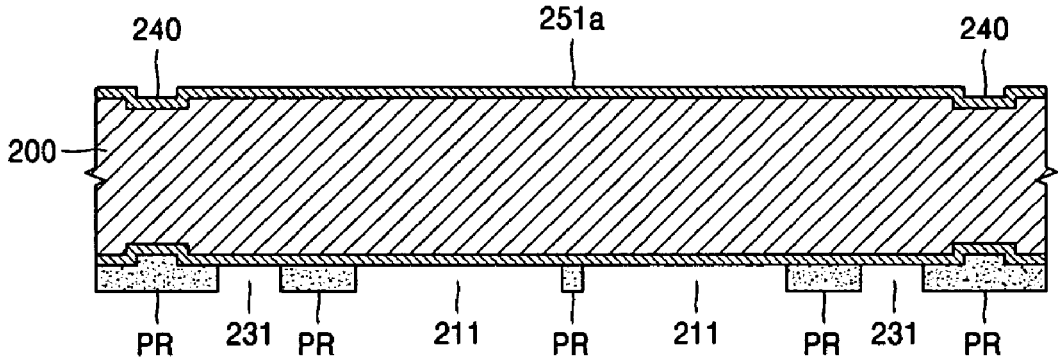

A base mark 240 may be formed on the edge portions of the upper and lower, i.e., backside, surfaces of the intermediate substrate 200. Since operations of forming the base mark 240 on the intermediate substrate 200 may be the same as the operations illustrated in FIGS. 14A through 14E, a detailed description thereof will be omitted. When the intermediate substrate 200 having the base mark 240 formed thereon is put into an oxidation furnace so as to wet-oxidize or dry-oxidize the intermediate substrate 200, the upper surface and the backside of the intermediate substrate 200 may be oxidized as illustrated in FIG. 17A to form the silicon oxide films 251*a* and 251*b*. Referring to FIG. 17B, a PR may be spread on the surface of the silicon oxide film 251*b*. Subsequently, the PR may be exposed and developed to form an opening 211 for forming the manifold 210 and an opening 231 for forming the damper 230 on the backside of the intermediate substrate 200.

Figure 17C:
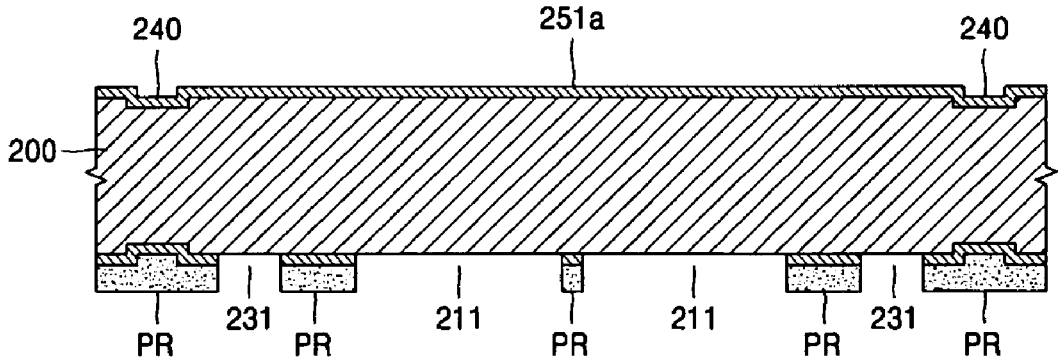
Figure 17D:
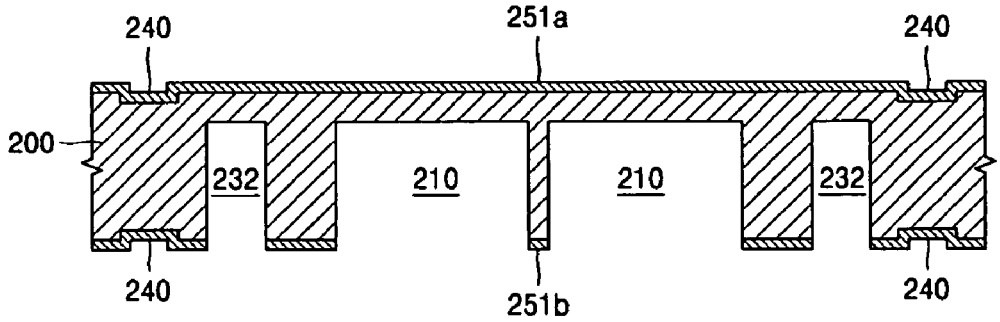

Referring to FIG. 17C, the backside of the intermediate substrate 200 may be partially exposed by removing the portion of the silicon oxide film 251*b* exposed by the openings 211 and 231 through, e.g., a wet etch process, using a PR for an etch-mask, after which the PR may be stripped. Referring to FIG. 17D, the exposed portion of the intermediate substrate 200 may be removed, e.g., through a wet etch process, to a predetermined depth using the silicon oxide films 251*b* for an etch-mask so as to form the lower portions of the manifold 210 and the damper 232. TMAH may be used as an etchant for silicon in wet-etching the intermediate substrate 200.

Figure 17E:
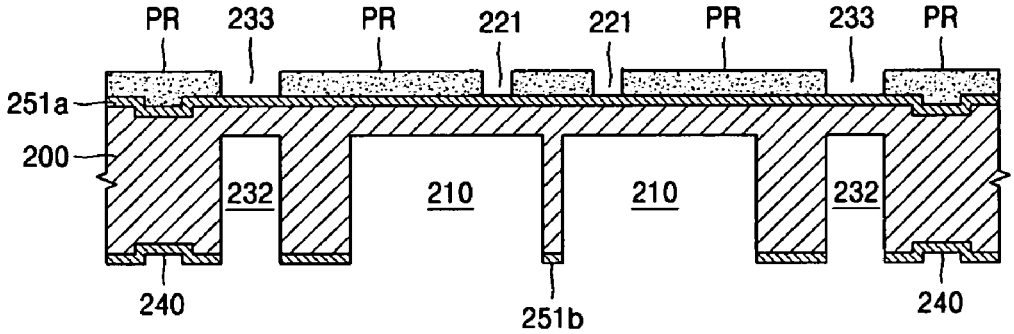
Figure 17F:
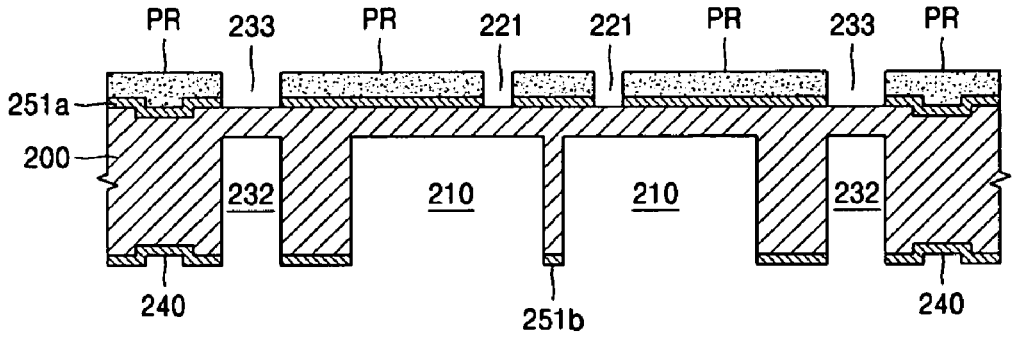

Referring to FIG. 17E, a PR may be spread on the surface of the silicon oxide film 251*a*. Subsequently, the PR may be exposed and developed to form an opening 221 for forming the second restrictor 220 and an opening 233 used in forming the upper portion of the damper 230 on the upper surface of the intermediate substrate 200. Referring to FIG. 17F, the upper surface of the intermediate substrate 200 may be partially exposed by removing the portion of the silicon oxide film 251*a* exposed by the openings 221 and 233 through, e.g., a wet etch process, to a predetermined depth using the PR for an etch-mask, after which the PR may be stripped.

Figure 17G:
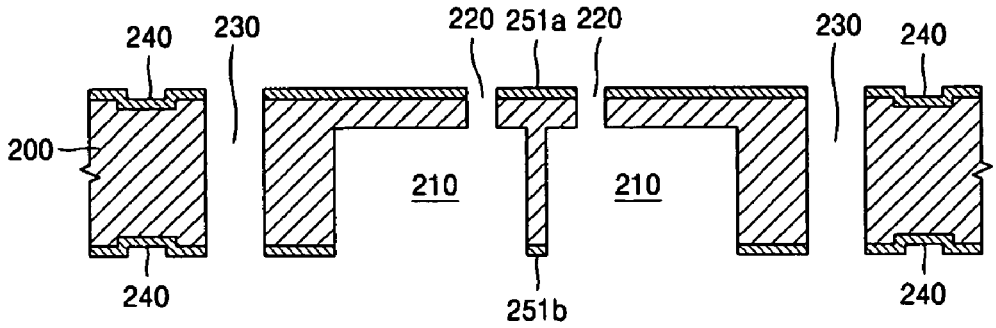
Figure 17H:
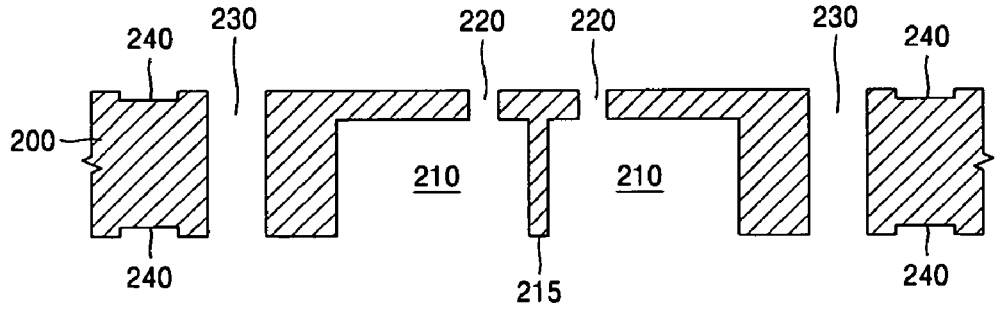

Referring to FIG. 17G, the exposed portion of the intermediate substrate 200 may be removed through, e.g., a wet etch process, to a predetermined depth using the silicon oxide films 251*a* for an etchmask to form the second restrictor 220 and the damper 230 that passes through the lower portion of the damper of FIG. 17D. After removing the remaining silicon oxide films 251*a* and 251*b* by, e.g., a wet etch process, the intermediate substrate 200 having the base mark 240, the second restrictor 220, the manifold 210, the partition wall 215, and the damper 230, may be produced as illustrated in FIG. 17H. Though not shown, a silicon oxide film may again be formed on the entire backside of the upper surface of the intermediate substrate 200 illustrated in FIG. 17H.

Figure 18A:
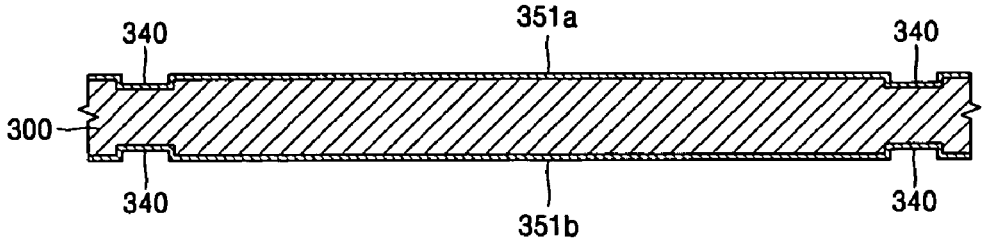
FIGS. 18A through 18H illustrate sectional views explaining operations of forming a nozzle on a lower substrate according to the present invention.

FIGS. 18A through 18H illustrate sectional views explaining operations of forming a nozzle on a lower substrate according to the present invention. Referring to FIG. 18A, the lower substrate 300 may be formed of a single-crystal silicon substrate and may have a thickness of 100-200 μm. A base mark 340 may be formed on the edge portions of the upper surface and the backside of the lower substrate 300. Since operations of forming the base mark 340 on the lower substrate 300 may be the same as the operations illustrated in FIGS. 14A through 14E, detailed description thereof will be omitted. The lower substrate 200, having the base mark 340 formed thereon, may be put into an oxidation furnace to wet-oxidize or dry-oxidize the upper surface and the backside of the lower substrate 300, as illustrated in FIG. 18A, to form silicon oxide films 351*a* and 351*b*.

Figure 18B:
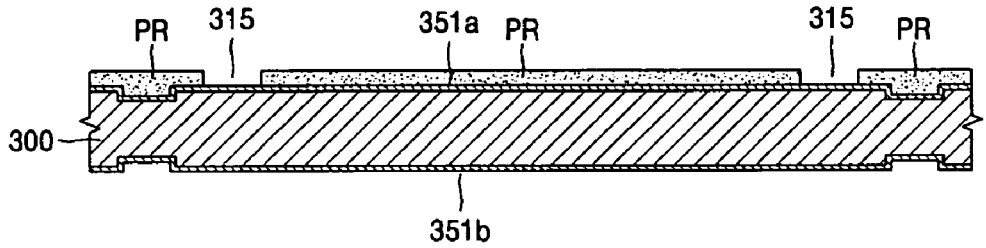
Figure 18C:
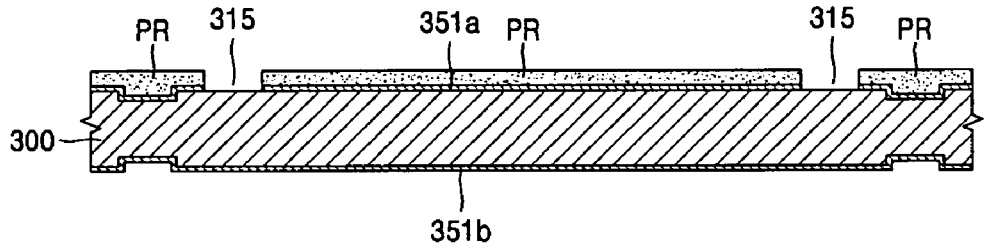

Referring to FIG. 18B, a PR may be spread on the surface of the silicon oxide film 351*a*, exposed and developed to form an opening 315, for an ink guide part 311 of the nozzle 310, on the upper surface of the lower substrate 300. The opening 315 may be formed at a position that corresponds the damper 230 formed in the intermediate substrate 200 illustrated in FIG. 17H. Referring to FIG. 18C, the upper surface of the lower substrate 300 may be partially exposed by removing the portion of the silicon oxide film 351*a* exposed by the opening 315 through, e.g., a wet etch process, to a predetermined depth using the PR for an etch-mask, after which the PR may be stripped. The silicon oxide film 351*a* may be removed by a dry etch process such as RIE.

Figure 18D:
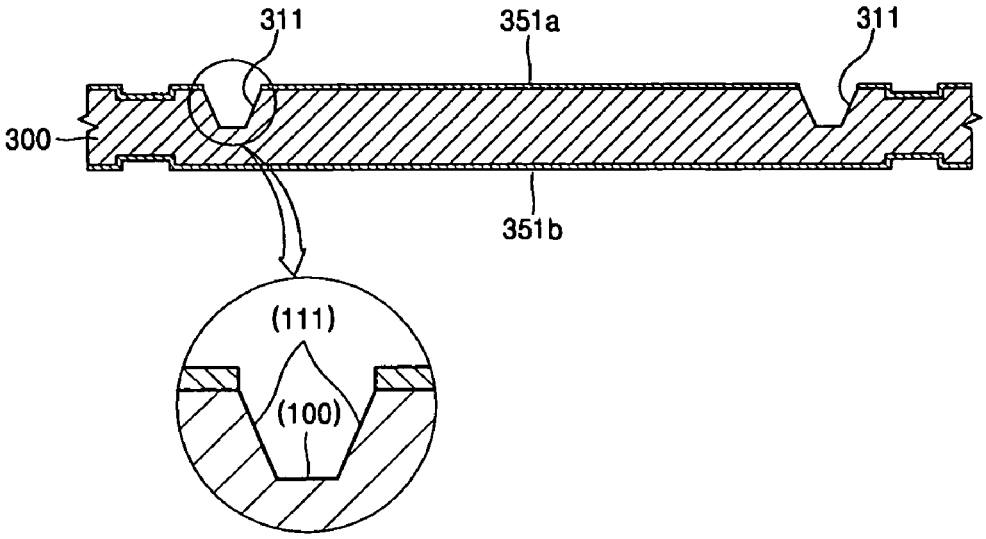

Referring to FIG. 18D, the exposed portion of the lower substrate 300 may be removed by, e.g., a wet etch process, to a predetermined depth using the silicon oxide films 351*a* for an etch-mask so as to form an ink guide part 311. TMAH may be used for etchant in wet-etching the lower substrate 300. When a silicon substrate having a (100) crystal face is used for the lower substrate 300, the ink guide part 311 having a quadrangular pyramid shape may be formed using an anisotropic wet etch process. In detail, since the etch speed of the crystallize face (111) is considerably slow compared with that of the crystallize face (100), the lower substrate 300 may be effectively wet etched to yield inclined surfaces along the (111) crystal face, thereby forming the ink guide part 311 having the quadrangular pyramid shape. As illustrated, the (100) crystal face becomes the bottom of the ink guide part 311.

Figure 18E:
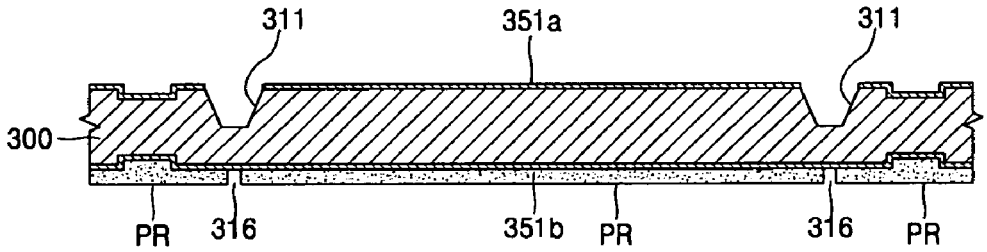
Figure 18F:
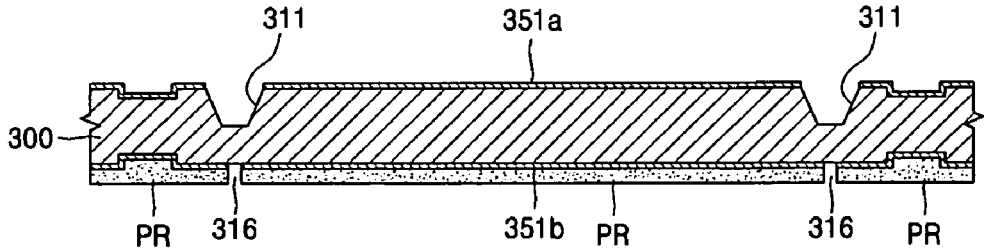

Referring to FIG. 18E, a PR may be spread on the surface of the silicon oxide film 351*b*, exposed and developed to form an opening 316 for an ink ejection port 312 of the nozzle 310. Referring to FIG. 18F, the backside of the lower substrate 300 may be partially exposed by removing the portion of the silicon oxide film 351*b* exposed by the opening 316 through, e.g., a wet etch process, using the PR for an etch mask. The silicon oxide film 351*b* may be removed by a dry etch process such as RIE.

Figure 18G:
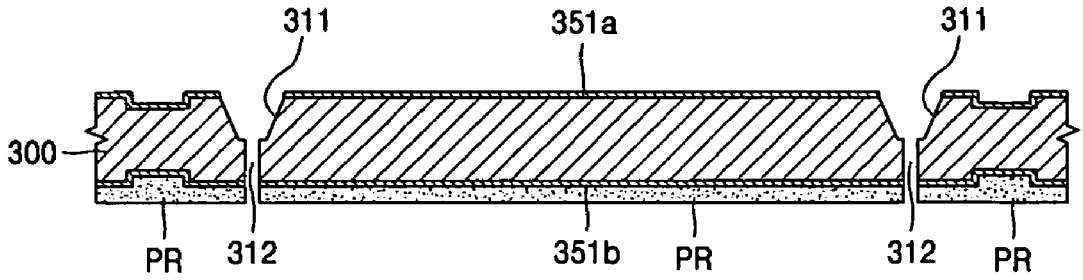
Figure 18H:
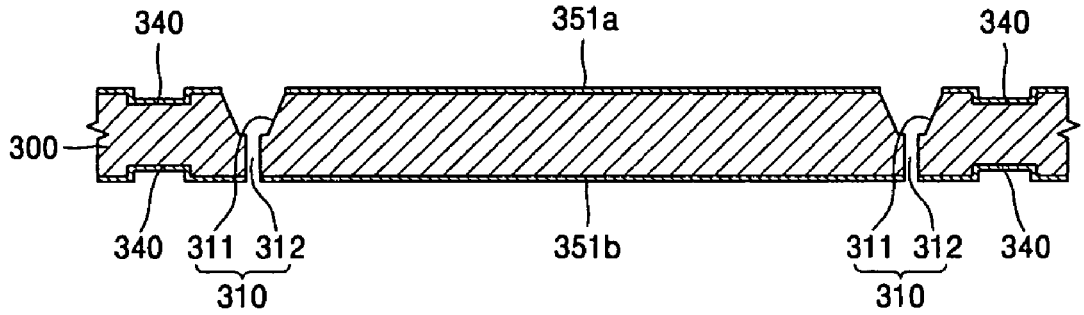

Referring to FIG. 18G, the exposed portion of the lower substrate 300 may be etched to pierce the lower substrate 300 using the PR for an etchmask, so that the ink ejection port 312 connected with the ink guide part 311 may be formed. The etching of the lower substrate 300 may be performed by, e.g., a dry etch process using an ICP. Subsequently, when the PR is stripped, the lower substrate 300 having the base mark 340 on the edge portions of the upper surface and the backside of the lower substrate, and the nozzle 310 consisting of the ink guide part 311 and the ink ejection port 312 formed in the lower substrate 300 is produced as illustrated in FIG. 18H. The nozzle 310 pierces the lower substrate 300.

The silicon oxide films 351*a* and 351*b* formed on the upper surface and the backside of the lower substrate 300, respectively, may be removed for washing, i.e., to rid the surfaces of contaminants, and, subsequently, a new silicon oxide film can be formed again on the entire surface of the lower substrate 300.

Figure 19:
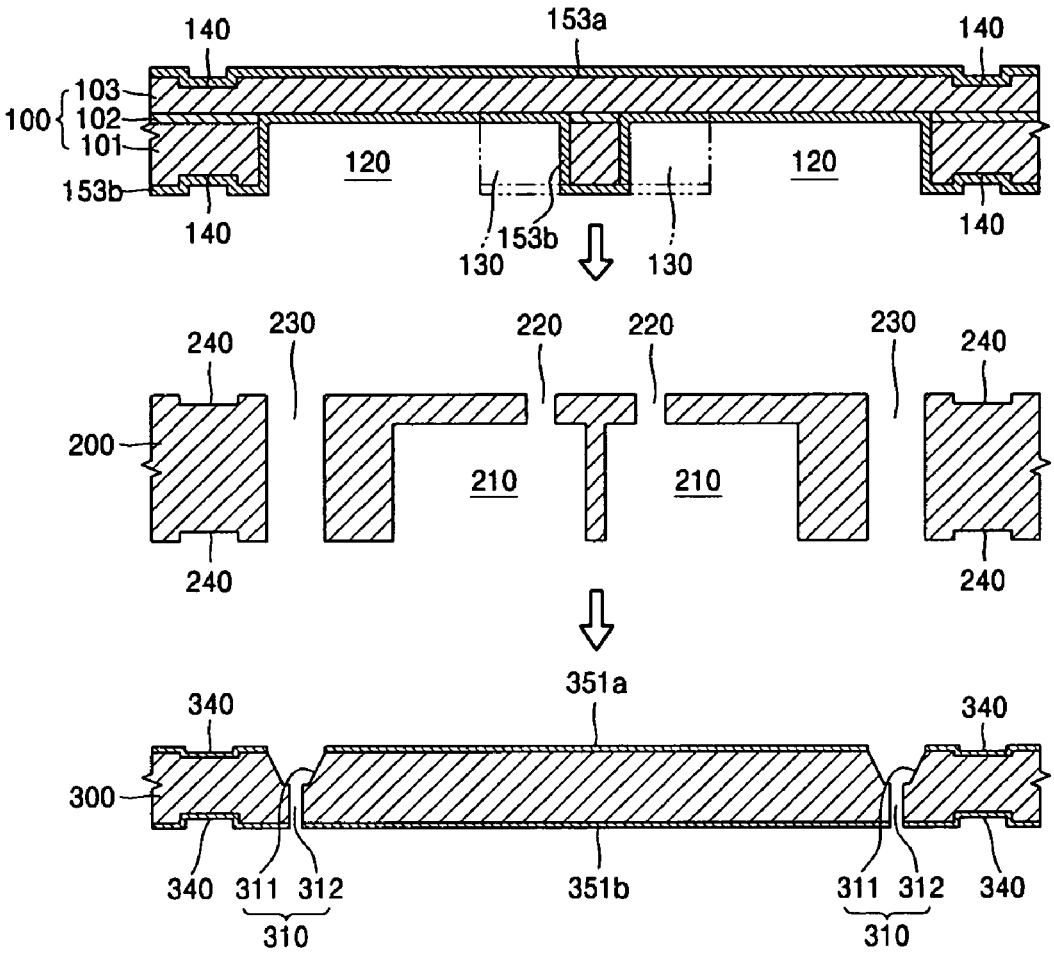
FIG. 19 illustrates a sectional view of an operation of stacking a lower substrate, an intermediate substrate, and an upper substrate to bond the same according to the present invention.

FIG. 19 illustrates a sectional view of an operation of stacking a lower substrate, an intermediate substrate, and an upper substrate to bond the same according to the present invention. Referring to FIG. 19, the lower substrate 300, the intermediate substrate 200, and the upper substrate 100 prepared by, e.g., the above-described processes, may be sequentially stacked and bonded to each other. After the intermediate substrate 200 is bonded on the lower substrate 300, the upper substrate 300 may bonded on the intermediate substrate 200, although the bonding order can be changed. The three substrates 100, 200 and 300 may be aligned using a mask aligner. Since the base marks 140, 240 and 340 for alignment are formed in each of the three substrates 100, 200 and 300, a highly accurate alignment may be achieved during the bonding process.

The bonding of the three substrates 100, 200 and 300 may be performed by, e.g., silicon direct bonding (SDB). In the SDB process, silicon-silicon oxide bonding is superior to silicon-silicon bonding. Therefore, referring to FIG. 19, the upper substrate 100 and the lower substrate 300 are used with the silicon oxide films 153*a*, 153*b*, 351*a* and 351*b* formed on the surfaces thereof, while the intermediate substrate 200 does not have a silicon oxide film on the surface thereof.

Figure 20A:
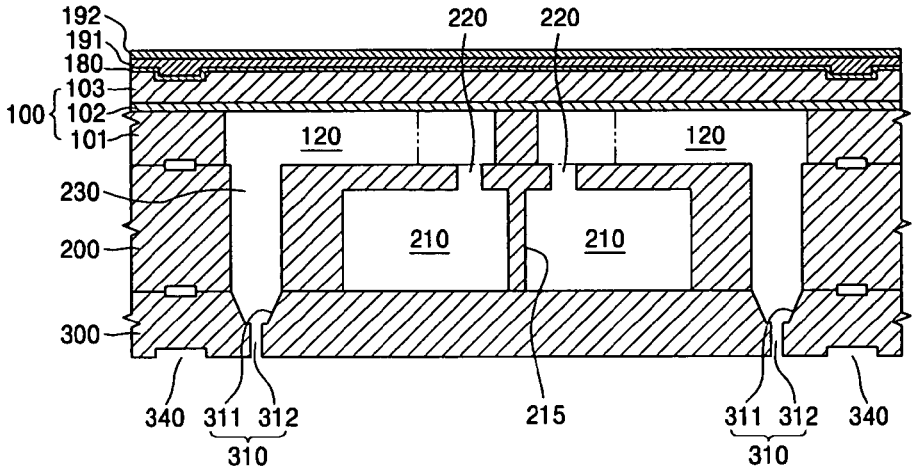
FIGS. 20A and 20B illustrate sectional views explaining operations of forming piezoelectric actuators on an upper substrate to complete a piezoelectric inkjet printhead according to the present invention.
Figure 20B:
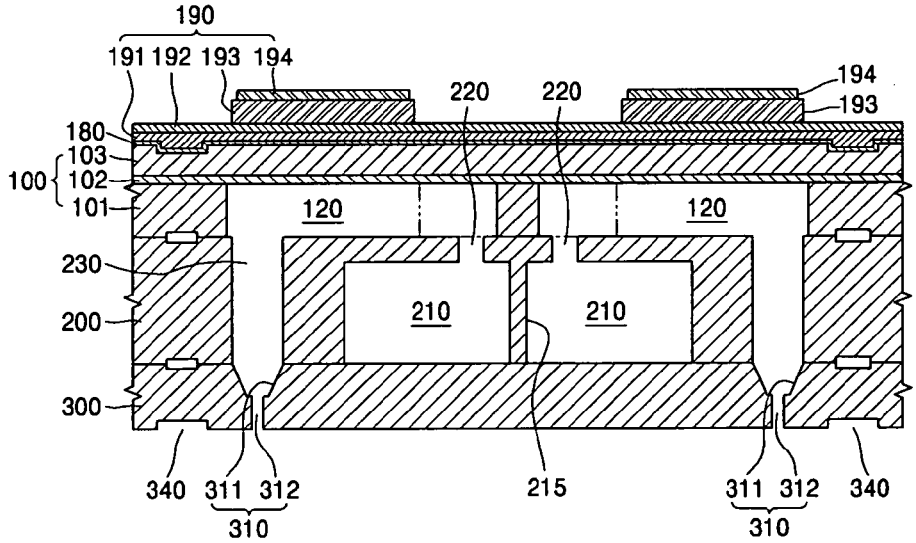

FIGS. 20A and 20B illustrate sectional views explaining operations of forming piezoelectric actuators on an upper substrate to complete a piezoelectric inkjet printhead according to the present invention. Referring to FIG. 20A, with the lower substrate 100, the intermediate substrate 200, and the upper substrate 300 sequentially stacked and bonded, a silicon oxide layer 180 as an insulation film may be formed on the upper surface of the upper substrate 100, although this operation may be omitted. That is, in the case where the silicon oxide film 153*a* is already formed on the upper surface of the upper surface 100, as illustrated in FIG. 19, or in the case where an oxide film of a sufficient thickness is already formed on the upper surface of the upper substrate 100, e.g., in the operation of annealing during the above-described SDB process, the silicon oxide layer 180 illustrated in FIG. 20A doesn't need to be formed thereon.

Lower electrodes 191 and 192 of the piezoelectric actuator may be formed on the silicon oxide layer 180. The lower electrodes may include two metal thin layers, e.g., a titanium (Ti) layer 191 and a platinum (Pt) layer 192. The Ti-layer 191 and the Pt-layer 192 may be formed on the entire surface of the silicon oxide layer 180 by, e.g., sputtering to a predetermined thickness. The Ti-layer 191 and the Pt-layer 192 may serve not only as a common electrode of the piezoelectric actuator, but also serve as a diffusion barrier layer that prevents inter-diffusion between the piezoelectric thin film 193 on the Ti-layer 191 and the Pt-layer 192 and the upper substrates 100 beneath the Ti-layer 191 and the Pt-layer. Particularly, the Ti-layer 191 at the lower portion increases adhesiveness of the Pt-layer 192.

Referring to FIG. 20B, a piezoelectric thin film 193 and an upper electrode 194 may be formed on the lower electrode 191 and 192. In detail, a piezoelectric material in a paste state may be spread to a predetermined thickness on the upper portion of the pressure chamber 120 using, e.g., screen printing, and then dried for a predetermined period of time. The piezoelectric material can be various materials, e.g., a general lead zirconate titanate (PZT) ceramic material. Subsequently, an electrode material, e.g., a gold-palladium (Ag—Pd) paste may be printed on the dried piezoelectric thin film 193. The piezoelectric thin film 193 may then be sintered under a predetermined temperature, e.g., a temperature range of 900-1,000° C. The above-described Ti-layer 191 and Pt-layer 192 may act as diffusion barriers to prevent any inter-diffusion between the piezoelectric thin film 193 and the upper substrate 100 that might be generated during a high-temperature sintering process. Thus, the piezoelectric actuator 190 consisting of the lower electrodes 191 and 192, the piezoelectric thin film 193 and the upper electrode 194 may be formed.

Since the sintering of the piezoelectric thin film 193 may performed in an open atmosphere, a silicon oxide film may be formed on the inside of the ink channel formed by the three substrates 100, 200 and 300 during sintering. Since the silicon oxide film formed in this manner does not react to most kinds of ink, a variety of ink may be used. Also, since the silicon oxide film has a hydrophilic property, inflow of air bubbles into the ink flow path when ink is initially filled in the ink channel may be prevented and air bubble generation may be suppressed when the ink is ejected.

A dicing process, cutting off the three bonded substrates 100, 200, and 300 by chip unit, and a polling process of applying an electric field to the piezoelectric thin film 193 to generate a piezoelectric characteristic may be used in completing the piezoelectric inkjet printhead of the present invention. Of course, dicing may be performed before the sintering process of the piezoelectric thin film 193.

While described above in detail in order to ensure a thorough understanding of the present invention, the method described herein for forming the respective elements of the printhead is merely exemplary and does not limit the present invention. For example, those skilled in the art will appreciate that various etching methods may be adopted and the order for the respective operations may be changed.

According to the piezoelectric inkjet printhead and the method of manufacturing the same of the present invention, it is possible to easily increase the width of the manifold by processing the backside of the intermediate substrate so as to form the manifold and install the manifold in the lower portion of the pressure chamber. Therefore, the volume of the manifold may be increase and the amount of ink accommodated therein similarly increased, so that pressure transferred to the inside of the manifold may be dispersively absorbed. Accordingly, when ink droplets are simultaneously ejected from the nozzles, crosstalk between adjacent restrictors may be reduced. Also, by increasing the width of the manifold, the cross-sectional area thereof is similarly increased and, thus, the flow resistance of the manifold is reduced. Accordingly, the amount of ink supply may be increased during the ink refill process that replaces the ejected ink and the printhead can stably operate even when ejecting ink at high-frequencies.

Further, according to the present invention, since the manifold may be formed below the lower portion of the pressure chamber and the first restrictor, with the manifold ceiling wall interposed therebetween, the substrate may save space to the extent that the width of the manifold in the arrangement of elements constituting an ink channel, and the chip size of printhead may be reduced. Therefore, the number of chips obtained per wafer may be increased, improving productivity.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A piezoelectric inkjet printhead comprising:

an upper substrate, an intermediate substrate, and a lower substrate that are sequentially stacked, wherein:

the upper substrate includes:

piezoelectric actuators on an upper surface of the upper substrate;

pressure chambers on a lower surface of the upper substrate, the lower surface of the upper substrate being substantially coplanar with lower surfaces of the pressure chambers; and first restrictors extending from the lower surfaces of the pressure chambers to upper surfaces of the pressure chambers, the first restrictors having a width smaller than a width of the pressure chambers, and the widths of the first restrictors and pressure chambers being measured alone a direction orthogonal to a lengthwise direction of the piezoelectric actuators, the intermediate substrate includes:

dampers passing therethrough, the dampers corresponding to the pressure chambers;

a manifold on a lower surface of the intermediate substrate, a bottom of the manifold being substantially coplanar with the lower surface of the intermediate substrate and with an upper surface of the lower substrate; and second restrictors extending between the first restrictors and the manifold, and the lower substrate includes:

nozzles passing therethrough, the nozzles corresponding to the dampers.

2. The printhead as claimed in claim 1, wherein a ceiling part of the intermediate substrate extends away from a sidewall of the manifold to define the upper surface of the manifold and the lower surfaces of the pressure chambers, the ceiling part being parallel to and overlapping the bottom of the manifold.

3. The printhead as claimed in claim 2, wherein the second restrictors pass through the ceiling part of the intermediate substrate to extend between the lower surfaces of the pressure chambers and the upper surface of the manifold.

4. The printhead as claimed in claim 1, wherein each of the upper substrate, the intermediate substrate and the lower substrate includes a single-crystal silicon substrate.

5. The printhead as claimed in claim 4, wherein:

the upper substrate includes a silicon on isolator wafer having a first silicon substrate, an intermediate oxide film, and a second silicon substrate, sequentially stacked, and the pressure chambers and the first restrictors are in the first silicon substrate, and the second silicon substrate serves as a vibration plate for the piezoelectric actuators.

6. The printhead as claimed in claim 1, wherein the intermediate substrate further comprises at least one support pillar that contacts the lower substrate, the support pillar extending from a surface of the intermediate substrate that defines an upper surface of the manifold.

7. The printhead as claimed in claim 1, wherein the intermediate substrate further comprises a blocking wall disposed between adjacent restrictors and extending from a surface of the intermediate substrate that defines an upper surface of the manifold.

8. The printhead as claimed in claim 1, wherein a width of the first restrictors in a width direction of the pressure chambers is less than a width of the second restrictors in the width direction of the pressure chambers.

9. The printhead as claimed in claim 1, wherein a width of the first restrictors in a width direction of the pressure chambers is greater than a width of the second restrictors in the width direction of the pressure chambers.

10. The printhead as claimed in claim 1, wherein the manifold has a partition wall formed therein along the length direction of the manifold, the partition wall extending from a surface of the intermediate substrate that defines an upper surface of the manifold.

11. The printhead as claimed in claim 10, wherein the partition wall contacts the lower substrate.

12. A method of manufacturing a piezoelectric type inkjet printhead, comprising:

in an upper substrate, forming an ink introducing port, pressure chambers, and first restrictors connected with the pressure chambers such that:

the pressure chambers are on a lower surface of the upper substrate, the lower surface of the upper substrate being substantially coplanar with lower surfaces of the pressure chambers, and the first restrictors extend from the lower surfaces of the pressure chambers to upper surfaces of the pressure chambers and have a width smaller than a width of the pressure chambers as measured along a direction orthogonal to a lengthwise direction of piezoelectric actuators on the upper substrate; in an intermediate substrate, forming a manifold to a predetermined depth from a lower surface of the intermediate substrate, second restrictors connected to the manifold, and dampers passing through the intermediate substrate; in a lower substrate, forming nozzles passing through the lower substrate;

bonding the lower substrate, the intermediate substrate and the upper substrate sequentially to each other such that:

the manifold connects with the ink introducing port and a bottom of the manifold is substantially coplanar with the lower surface of the intermediate substrate and with an upper surface of the lower substrate, the second restrictors extend between the first restrictors and the manifold, the dampers connect with the pressure chambers, and the nozzles connect with the dampers; and forming the piezoelectric actuators on an upper surface of the upper substrate.

13. The method as claimed in claim 12, further comprising:

forming a base mask on each of the three substrates, the base mask serving as an alignment reference in the bonding of the substrates.

14. The method as claimed in claim 12, wherein the ink introducing port, the pressure chambers, and the first restrictors are formed by etching the lower surface of the upper substrate.

15. The method as claimed in claim 12, wherein each of the upper substrate, intermediate substrate and lower substrate are formed from a single crystal silicon wafer, the upper substrate is an SOI wafer including a first silicon substrate, an intermediate oxide film, and a second silicon substrate sequentially stacked, and forming the ink introducing port, the pressure chambers, and the first restrictors includes etching using the intermediate oxide film as an etch stop layer.

16. The method as claimed in claim 12, wherein forming a manifold to a predetermined depth from a lower surface of the intermediate substrate, second restrictors connected to the manifold, and dampers passing through the intermediate substrate comprises:

forming a first etch mask having a predetermined pattern on a lower surface of the intermediate substrate;

forming the manifold and a lower portion of the dampers by etching the lower surface of the intermediate substrate to a predetermined depth using the first etch mask;

forming a second etch mask having a predetermined pattern on an upper surface of the intermediate substrate; and forming the second restrictors and an upper portion of the dampers that is connected with the lower portion of the dampers by etching the upper surface of the intermediate substrate to a predetermined depth using the second etch mask.

17. The method as claimed in claim 12, wherein forming nozzles passing through the lower substrate comprises:

forming ink guide parts connected with the dampers by etching an upper surface of the lower substrate to a predetermined depth; and forming ink ejection ports connected with the ink guide parts by etching a lower surface of the lower substrate.

18. The method as claimed in claim 17, wherein the lower substrate is formed from a single crystal silicon wafer having a major surface parallel to a (100) crystal plane, and wherein the ink guide parts are formed to have inclined side surfaces by using an anisotropic etch process.

19. The method as claimed in claim 12, wherein the bonding of the three substrates is performed by silicon direct bonding.

20. The method as claimed in claim 12, further comprising: forming a silicon oxide film on the upper substrate before forming the piezoelectric actuators.

* * * * *